US005992664A

United States Patent [19]

Trapp et al.

[11] Patent Number: 5,992,664

[45] Date of Patent: Nov. 30, 1999

[54] PORTABLE BOX

[75] Inventors: Rudiger Trapp, Quimbach/Pfalz; Gerd Bauml, St. Wendel, both of Germany

[73] Assignee: Koordination GLOBUS-Betriebe GmbH & Co. KG, St. Wendel, Germany

[21] Appl. No.: 09/059,344

[22] Filed: Apr. 14, 1998

Related U.S. Application Data

[63] Continuation of application No. PCT/EP98/00366, Jan. 23, 1998.

[30] Foreign Application Priority Data

Jan. 24, 1997 [DE] Germany ..... 297 01 203

[51] Int. Cl.[6] ..... B65D 7/00

[52] U.S. Cl. ..... 220/6; 220/4.32; 220/7

[58] Field of Search ..... 220/6, 7, 4.31, 220/4.32, 4.33, 4.34

[56] References Cited

U.S. PATENT DOCUMENTS

| | | | |
|---|---|---|---|
| 1,620,143 | 3/1927 | Trimble . | |
| 2,023,886 | 12/1935 | Hoffman | 220/6 |
| 2,558,126 | 6/1951 | Davenport | 220/6 |
| 2,755,955 | 7/1956 | Gordon . | |
| 2,782,955 | 2/1957 | Gordon . | |
| 4,491,231 | 1/1985 | Heggeland et al. | 220/6 |
| 4,498,598 | 2/1985 | Bae | 220/6 |
| 4,789,075 | 12/1988 | Sun | 220/6 X |
| 4,820,383 | 4/1989 | Shchamorov et al. | 220/6 |
| 5,181,612 | 1/1993 | Liu . | |

FOREIGN PATENT DOCUMENTS

| | | |
|---|---|---|
| 30 13 180 | 10/1981 | Germany . |
| 31 16 198 | 11/1982 | Germany . |
| 38 17 871 | 12/1989 | Germany . |
| 43 11 142 | 3/1995 | Germany . |

OTHER PUBLICATIONS

German Gebrauchsmuster 1,693,496; Dipl.–Ing. Heinz Lesser; Feb. 17, 1955. (w/trans.).

*Primary Examiner*—Steven Pollard

*Attorney, Agent, or Firm*—Jacobson, Price, Holman & Stern, PLLC

[57] ABSTRACT

A portable box of essentially rectangular shape, having stiff components (side walls, cover, bottom member, front wall, and rear wall) which are movably interconnected by means of pivots, hinges, or the like, such that said components can be folded or collapsed onto one generally planar surface, which may be that of the bottom member, the back wall, a side wall, or the front wall. At least one pivot or hinge connection between at least two components of the box is comprised of at least one guide channel extending along one box component, and a joint element associated with the second box component, which joint element is linearly slidably accommodated in the channel, wherein the second box component can be swung around a non-displaceable swing axis by means of its pivot or hinge connection which connects it to a third box component. The connection is distant from said joint element, wherein the first box component is moved toward and is parallel to the third box component.

35 Claims, 20 Drawing Sheets

PORTABLE BOX

This is a continuation of International Application PCT/EP 98/00366 designating the United States of America filed on Jan. 23, 1998.

BACKGROUND OF THE INVENTION

1. Field of the Invention

The invention relates to a portable box.

2. Description of the Related Art

In Ger. OSs 31 16 198 and 30 13 180, a portable insulated container, e.g. in the form of a box-shaped so-called cooler, is described, wherein at least part of the container wall is comprised of light-transparent insulating material. This feature is intended to enable the cashier of a retail establishment to inspect the contents of the container without the need to remove any of the cooled or frozen goods therefrom. Thus the insulated container can provide continuous protection for the purchased goods from the refrigerator or freezer of the retail establishment to the private refrigerator or freezer of the purchaser.

A cooler which is suited to the stated purpose, which cooler is described in the cited publications, has the disadvantage of being too bulky. It becomes particularly inconvenient to carry a somewhat large cooler if it turns out that the goods one wishes are not in stock in the retail establishment, so that the cooler must be brought home empty.

In Ger. OS 38 17 871, a temperature-controlled cooler is described which has a separate chamber to accommodate a cooling source in the form of a cooling medium or other reservoir of cold. A device for circulating air is also provided in the box. The box is large and heavy, and capable of carrying only a relatively small volume of goods.

Ger. Pat. 4,311,142 C2 discloses a shipping box which has a sliding side wall to receive the goods in the box. The box folds up, but the folding process is very complex. Ger. Gebrauchsmuster 1,693,496 discloses a collapsible carrying container which is very difficult to set up after collapsing.

SUMMARY OF THE INVENTION

The underlying problem addressed by the present invention is to devise a portable box which is easier for customers to carry and handle than are known boxes. This problem is solved according to the invention in that at least one pivot or hinge connection between at least two components of the box comprises at least one guide channel extending along one box component, and ajoint element associated with the second box component. The joint element is linearly slidably accommodated in said channel, wherein said second box component can be swung around a non-displaceable swing axis by means of its (a second) pivot or hinge connection which connects it to a third box component, which connection is distant from the aforesaid joint element. The swinging of the second box component occurs relative to said third box component, and wherein said first box component is moved toward and is parallel to said third box component.

This enables one to fold or collapse the box components into a relatively flat, compact state, without having to disrupt the basic interconnections of the box components. A further advantage is that the described special articulated connection between at least two box components which enables two of the box components to be moved toward each other in (or into) a parallel state allows substantial variation in the ratios of the various dimensions of the box. Moreover, the risk of loss or damage to box components (particularly the cover) is eliminated, because the box components remain connected when the box is folded up or collapsed.

According to a particularly preferred embodiment of the invention, a connection between each of the side walls and the front wall is provided by, in each case, a pivot or hinge connection formed from a guide channel and the joint element which is accommodated in and is linearly movable in said channel, as described. This provides the connections of three of the box components in the inventive system.

According to an advantageous embodiment of the invention, a hinge connection is provided between the bottom member and the rear wall, which hinge connection is comprised of fork-like hinge bearings and hinge plates disposed on neighboring edges, which bearings and plates are disposed in a mutually intermeshing arrangement, wherein a hinge journal passes through said bearings and plates. Similar hinge connections are provided between each side wall and the rear wall. The hinge connection between the bottom member and the rear wall allows the bottom member to be swung up against the inner surface of the rear wall. The hinge connection between the cover and the rear wall allows the cover to be swung around the hinge axis in an arc of around 270°, to a position against the outer surface of the rear wall. The hinge connections between the individual side walls and the rear wall allow the side walls to be swung around the respective hinge axes to a position against the bottom member after the bottom member has been swung up against the rear wall, wherein during said swinging of the side walls, the front wall is moved backward toward the rear wall and comes to rest against the side walls which in turn have been swung so as to come to rest against the bottom member. With this arrangement, when the user later unfolds the box, the user does not need to intervene to establish the various hinge connections, nor does the user need to engage locking means for the various box components in the unfolded state, because these effects are automatically part of the unfolding process, in that all of the connections are constantly in effect during the entire folding and unfolding processes.

It is provided according to an advantageous embodiment of the invention that the joint elements associated with the side walls which elements are linearly movably accommodated in the guide channels of the front wall are swingable around a respective bearing journal (rod) which is disposed near the front wall at an end structure of the respective side wall and which extends between the cover and the bottom member. This arrangement avoids jamming of the connections which have both angular and linear degrees of freedom. Preferably, each such bearing journal is disposed in a recess in the respective side wall, which recess is open on its end face directed toward the front wall and on its exterior side, so that the hinge members guided in the recess can execute a suitable rotational excursion without striking any box components.

Preferably the joint elements associated with the side walls are each comprised of a hammer-shaped head member and a fork-shaped bearing member formed on said head member, wherein the bearing journal disposed in the edge region of the given side wall, which region is closest to the front wall component of the box, is encirclingly engaged by said fork-shaped member, in kinematic engagement. This arrangement provides a means which furnish the desired linkages between the side walls and the front wall of the box but wherein the joint elements are prevented from being pulled out of the guide channels during the described collapsing and un-collapsing of the box.

According to a particularly preferred embodiment of the invention, the guide channels are each disposed in a recess in or on the front wall which recess is open toward the interior space of the box and extends transversely between the side walls. Each of the guide channels is essentially U-shaped, and forms a guide chamber for the hammer-shaped head of the joint element for the given side component, wherein said head is undercuttingly engaged by two oppositely directed projections on the guide channel.

Each of the box components is itself in the form of a hollow chamber profile, which can be filled with thermally insulating material. It is also possible to fill such hollow chambers with coolant gas, wherein valves may be provided for this purpose. According to a particularly preferred embodiment, each box component is comprised of least two pieces. In particular, each box component may be fabricated from a base piece and a skin piece, wherein these pieces may bear, on their mutually facing inner sides, plug means, clip means, or catch means, which aid in fastening them together.

A recess may be provided in the outer side of the rear wall, which recess is suitable for accommodating the cover when said cover is swung open. In this way, the cover can be held out of the way without protruding beyond the regular boundaries of the rear wall.

In order to limit the swinging excursion of the bottom member when the box is in the unfolded state (ordinary use state), a support strip for the bottom member to abut against is provided on the front wall. This support strip has the outward appearance of a foot strip; accordingly, a corresponding foot, with the same thickness, is provided on the corresponding edge of the rear wall.

Preferably, means for lifting the bottom member are provided in or on the inner side of the bottom member, such means being, e.g., in the form of a gripping recess.

The rear wall has side members which extend in the planes of the side walls and form part of said side walls. The widths of the side walls proper may be selected to conform with the widths of these side members of the rear wall. Said side members create a recess between the forwardmost edges of the side members and the inner surface of the rear wall, which recess accommodates the bottom member and side walls when said bottom member and side walls are folded-in. In a particularly preferred embodiment, hinge means are accommodated in or on the side members.

If the portable box is to be used as a cold container (so-called cooler), pocket-like compartments provided on the rear wall inside the box may be used to accommodate cooling elements.

According to a preferred embodiment of the invention, a carrying handle is provided which also serves as a locking and sealing element. For this purpose, retention nubs are provided on the exterior sides of the side walls, which nubs can be undercuttingly engaged by hook-shaped arms borne on the carrying handle. The carrying handle is essentially in the form of a U-shaped member with the arms of the "U" extending parallel at a mutual distance, in particular extending over the exterior sides of the respective side walls, wherein said arms each bear one or more hooks at their free ends. Each of the said arms is penetrated by an elongated slot which extends in the longitudinal direction of the arm, which slot slidably accommodates an engaging-and-locking member disposed on the respective side of the cover, which engaging-and-locking member serves as a pivot for swinging and rotational movements. The engaging-and-locking members are irrotationally fixed to the cover, e.g. said members may be integrally formed members of said cover. The described configuration of the carrying handle enables the handle to be swung around the swing axis provided by the engaging-and-locking members, and also to be moved translationally with respect to said axis. When the hook-shaped arms on the carrying handle are undercuttingly engaged with the retention nubs disposed on the outer surfaces of the side walls, the result is that the cover is pressed, i.e. held in place, against the side walls, rear wall, and front wall, because under these circumstances the engaging-and-locking members cannot move in the longitudinal slots, in that in order to do so they would have to simultaneously execute a swinging movement around the hinge axis between the cover and the rear wall. The longitudinal slots are held vertical. Thus the carrying handle effectively keeps the cover closed.

It is seen therefore that the inventive generally rectangular portable box has stiff components (side walls, cover, bottom member, front wall, and rear wall) which components are mutually movable but can be fixed in certain positions, wherein the box can be folded or collapsed into a compact flat structure against the rear wall or front wall. Until the time when the shopper finds the goods he is seeking, the box can be maintained in this compact state. The shopper will find it convenient to carry the box in the chance a suitable object, e.g. a frosty product, will be found to be carried in it. The folded or collapsed box will then be at hand, clean and ready for use.

According to an advantageous embodiment of the invention, each side wall is articulated at a central folding line which extends parallel to the rear wall. This allows the bottom member to be folded up against the rear wall, wherein the side walls can be collapsed between the front wall and folded-up bottom member, with the front wall being moved back against the rear wall assembly.

In order to hang the box on, e.g., a shopping cart, swingable hooks may be provided which are accommodated in a recess in the rear wall which recess is open to the exterior. When it is desired to use the hooks, they can be swung out from said recess.

Any known method may be used to fabricate the inventive box. The box and its components may be fabricated using a so-called sandwich process, or may be blow-molded or roll-formed. A box thus fabricated may be used as a heating, insulating, or cooling box for shopping purposes, and may also find many uses in industry and in leisure activities.

BRIEF DESCRIPTION OF THE DRAWINGS

Preferred embodiments of the invention will be described hereinbelow, with reference to the accompanying drawings which illustrate certain preferred embodiments.

DETAILED DESCRIPTION OF THE PREFERRED EMBODIMENT

Figure 1:
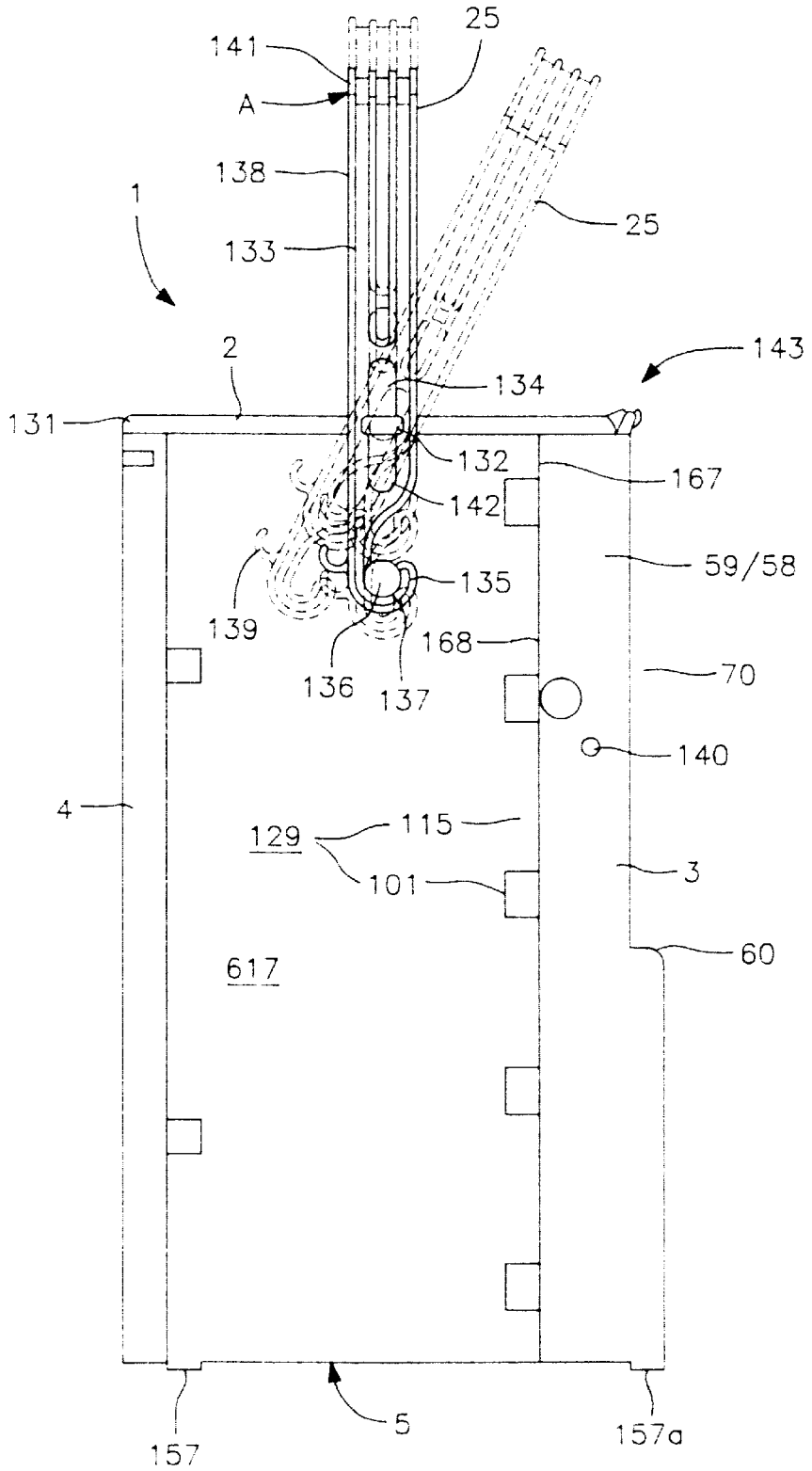
FIG. 1 is a lateral view of the inventive box.
Figure 2:
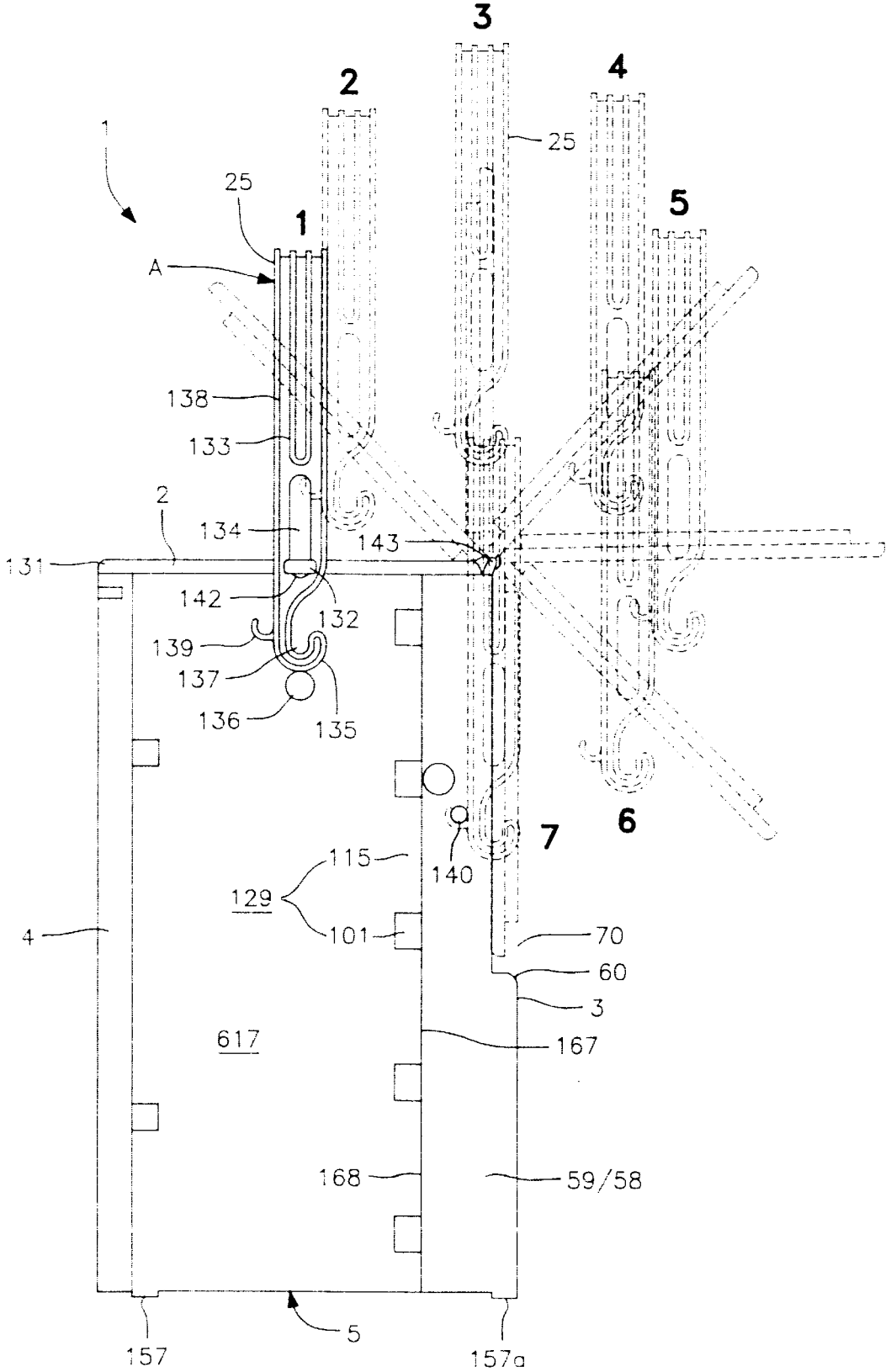
FIG. 2 is a lateral view of the box according to FIG. 1, wherein the swinging of the cover at various positions up to and including its final position at the rear wall is illustrated.

FIGS. 1–9 and the detail drawings FIGS. 10–16 illustrate a particularly preferred embodiment of the invention. The box 1 is essentially in the form of a rectangular box, and has generally rigid components (side walls 6 and 7, cover 2, bottom 5, front wall 4, and rear wall 3) which are mutually movable so that the box can be folded or collapsed flat against the front or rear wall. The box illustrated in connection with this exemplary embodiment is an insulated box, e.g. a cooler.

Figure 8:
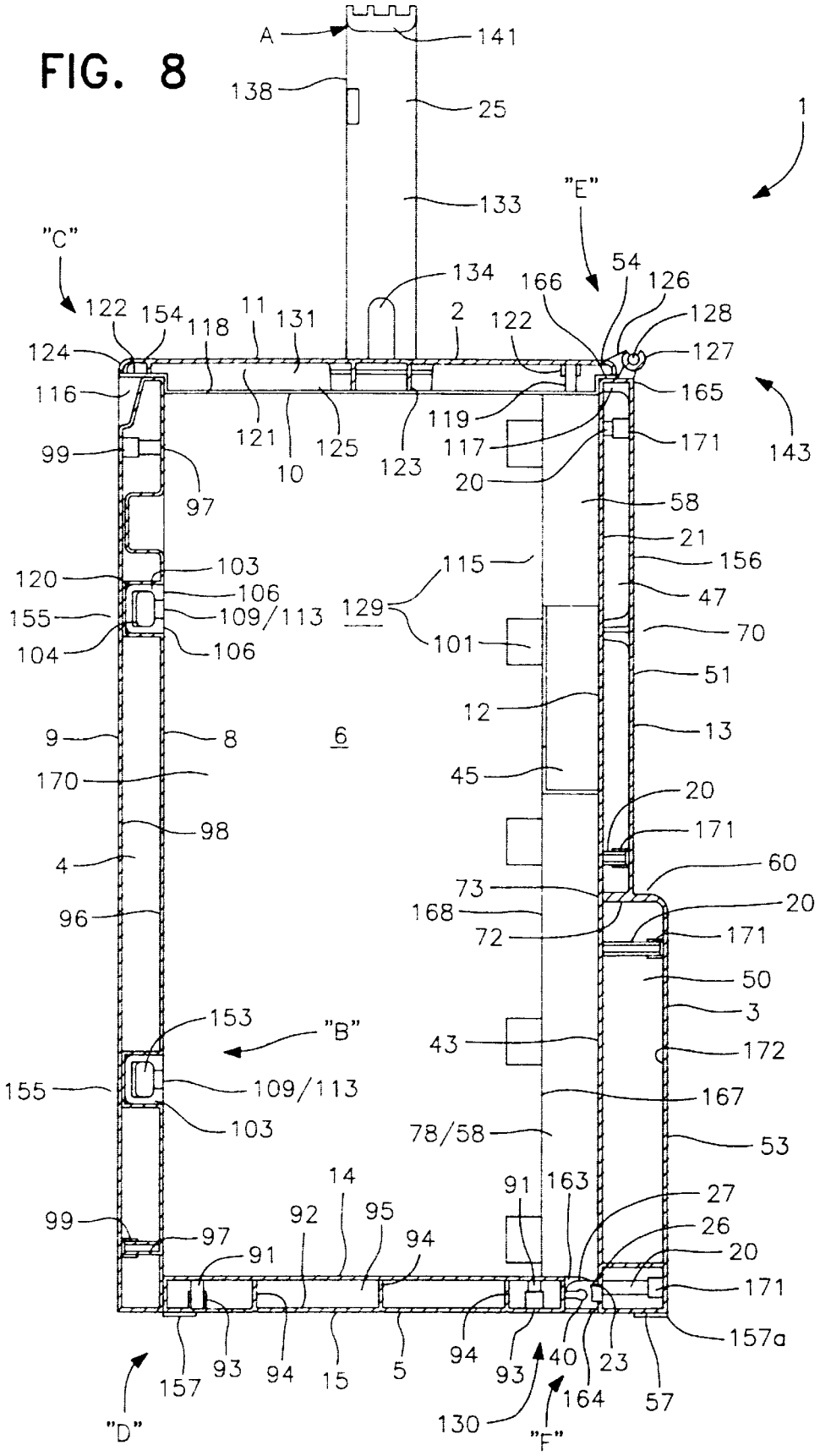
FIG. 8 is a vertical cross section through the box.
Figure 9:
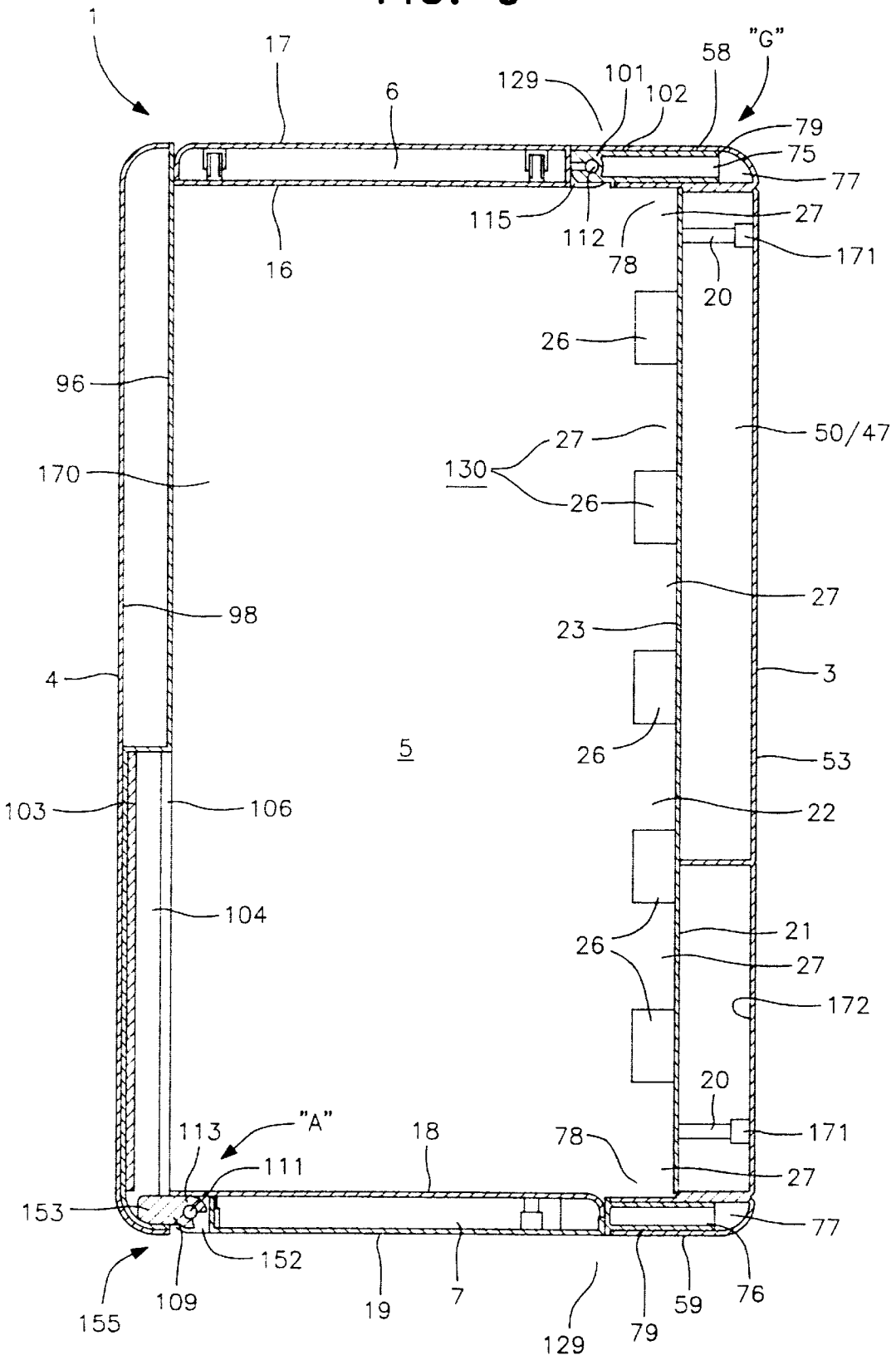
FIG. 9 is a horizontal cross section through the box.
Figure 15:
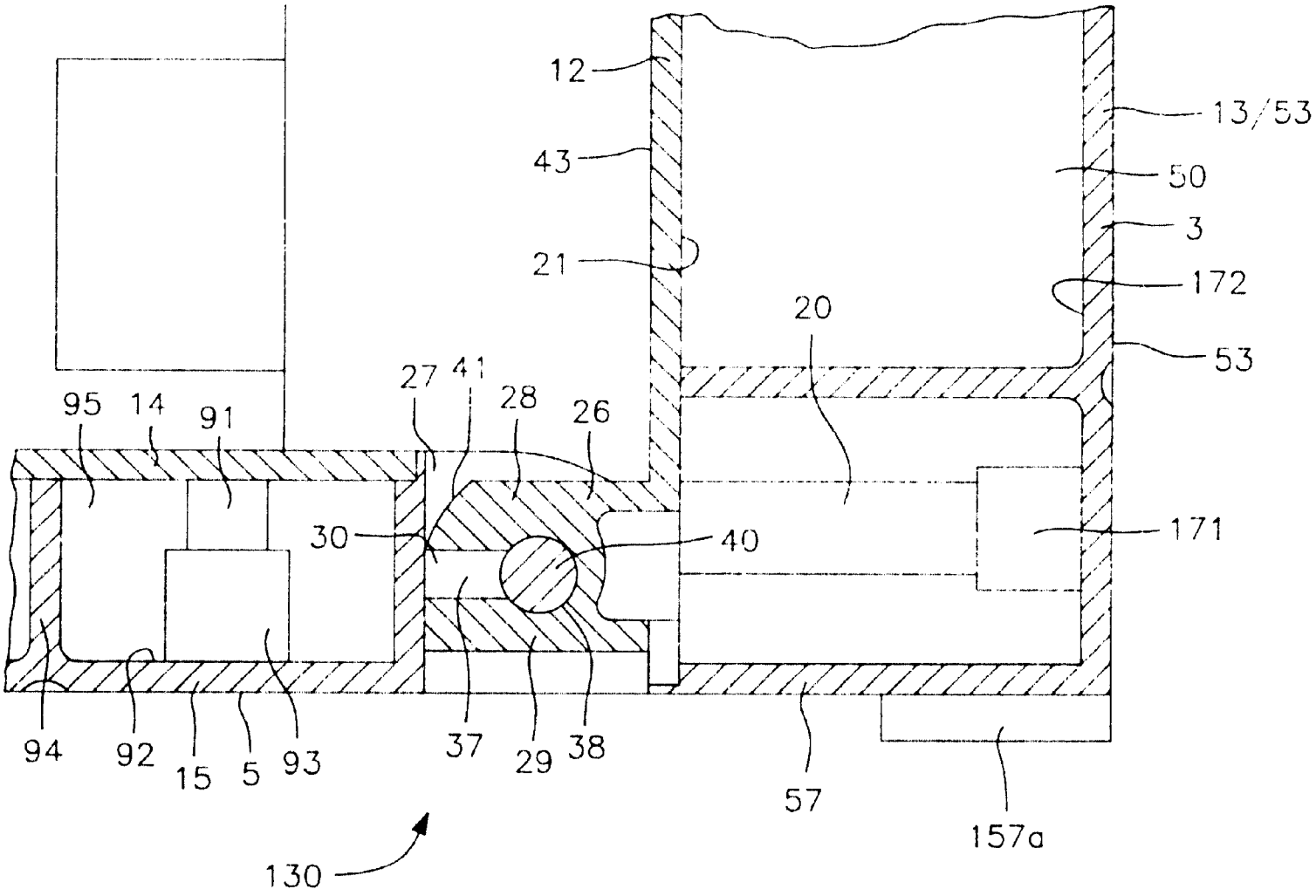
FIG. 15 is an enlarged view of detail "F" of FIG. 8.

One can best see the individual parts in the cross sections of FIGS. 8 and 9 and the associated detail drawings, FIGS. 10–16. The rear wall 3, front wall 4, cover 2, bottom 5, and side walls 6, 7 are in the form of hollow chamber profiles. These components are each comprised of at least two pieces, namely a base piece (8, 10, 12, 14, 16, 18) and a skin piece (9, 11, 13, 15, 17, 19). The base piece 12 of the rear wall 3 is essentially a flat plate, and bears, at locations which are advantageously distributed over the surface, pins 20 which extend from the inner side of base piece 21 to the skin piece 13 and which interact with corresponding sleeves 171 on the inner side 172 of the skin piece 13 with the aid of clamp means. At the lateral border 23 of rear base piece 12 near the bottom 5, in this exemplary embodiment, five fork-type hinge bearings 26 are provided at intervals along the base piece 12 which extend therefrom and are interspersed with the hinge plates 27 extending from the bottom member 5. As seen in FIG. 15, the bearing forks 26 each comprise two parallel arms 28, 29 disposed at a mutual distance which form a claw 30 having an opening 37 on its free end. At the end opposite to opening 37, the notch in the claw is configured to serve as a bearing seat 38. Bearing journals 40 extend through the seat(s) 38 and through the hinge plates 27 of bottom member 5. The upper arm 28 of the bearing fork 26 has a rounded outer surface 41 on its free end.

On the inner surface 43 of the base piece 12 which inner surface is directed toward the interior space of the box a pocket-like compartment 45 (FIG. 8) is provided, for accommodating cooling elements. The skin piece 13 forms part of the outer wall of the box 1. At least one hollow chamber (47 and/or 50) is formed between the base piece 12 and skin piece 13. The thickness of the chamber is defined by the edge position 54 and the middle position 57. The skin 51 has a step-shaped profile, with a step 60 at generally the mid-elevation region between the bottom member and the cover, wherein the skin element 51 is recessed with respect to the skin element 53, forming a corresponding recess 70 which has a thickness corresponding approximately to that of the cover 5. At the elevation of the step 60 a spacing cross-member 72 is provided which is present as either a web member which extends through the entire length of the box or a series of projections 73 distributed along the length of the box. If member 72 is an uninterrupted web member, the base piece 12 is thereby effectively divided into an upper and a lower region, wherein the two regions of the single base 12 may be supported by web member 72, or base piece 12 may be comprised of two separate elements which abut against web member 72. If member 72 is a series of projections 73, the base piece 12 may be of unit construction, perforated with corresponding throughgoing openings to accommodate the projections.

The side members 58, 59 (FIG. 9) are in the form of compartments for accommodating the hinge arms 75, 76. The arms 75, 76 can be inserted or pressed into corresponding hollow recesses 77 in said side members 58, 59. The length of the side members 58, 59 should be such that they extend far enough beyond the base piece 12 of rear wall 3 (projection 78) to accommodate the bottom member 5 when said bottom member is swung upward (following which the side walls 6 and 7 can be swung-in to overlap bottom member 5).

The hinge arms 75, 76 each have a fastening part 79, and on the end of said fastening part 79 directed toward the respective side wall 6, 7 they have a series of superposed fork-type hinge bearings 101. The fastening part 79 may comprise a plurality of arm members superposedly distributed along the height of the rear wall, or may comprise a single hollow rectangular member. Independently of the choice of the configuration of the fastening part 79, a ridge 102 is provided which covers and has a sealing function for the hollow chamber 77 of the side member 58, 59. As seen clearly in FIG. 16, the bearing forks 101 (similarly to the bearing forks 26) each comprise two parallel arms 86, 110 disposed at a mutual distance which form a claw 88 having an opening suitable for introducing the bearing journal 112, wherein in an interior location of the bearing fork a wider bearing seat 89 is provided in which eventually the journal 112 comes to be supported. In order to facilitate the swinging-in of side walls 6 and 7 without friction or other resistance, the arm 86 of each bearing fork 101 has a rounded outer surface 90.

The bottom member 5 is comprised of a base piece 14 and a skin piece 15. The base piece 14 is essentially a flat plate which bears downwardly directed pins 91 which are accommodated and guided in corresponding bushings 93 extending from the inner side 92 of the skin piece 15. Spacing cross-members 94 are disposed at intervals over the internal side 92 of the skin piece 15. These members 94 are essentially in the form of web members which form at least one hollow chamber 95 in the bottom member 5. At the edge of bottom member 5 directed toward the rear wall 3, member 5 bears hinge plates 27 which project into the spaces between neighboring bearing forks 26.

Similarly to the bottom 5, side walls 6, 7, and rear wall 3, the front wall 4 is in the form of a hollow chamber profile comprised of a base piece 8 and a skin piece 9. The base piece 8 is essentially a flat plate which bears pins 97 which extend outward from the inner side 96 of piece 8 which side 96 faces toward the skin piece 9. The pins 97 can be inserted into and guided in corresponding sleeves 99 disposed on the inner side 98 of the skin piece 9.

Figure 11:
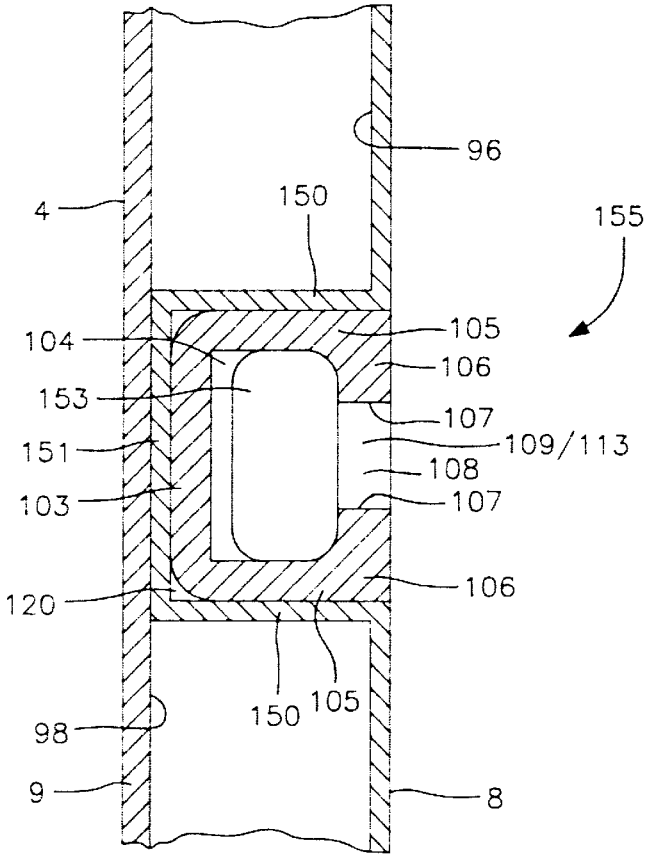
FIG. 11 is an enlarged view of detail "B" of FIG. 8.
Figure 10:
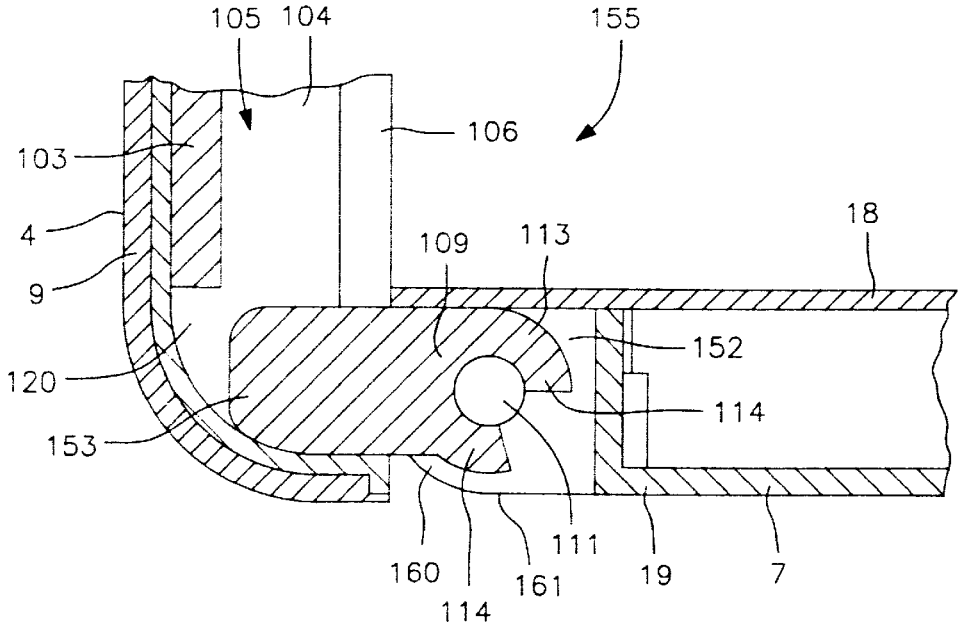
FIG. 10 is an enlarged view of detail "A" of FIG. 9.
Figure 12:
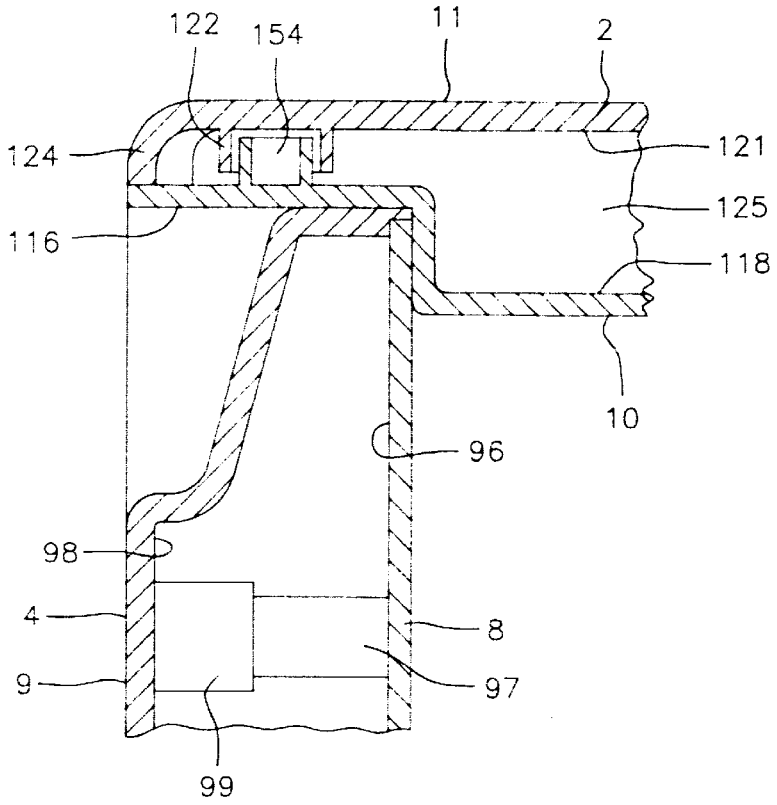
FIG. 12 is an enlarged view of detail "C" of FIG. 8.
Figure 13:
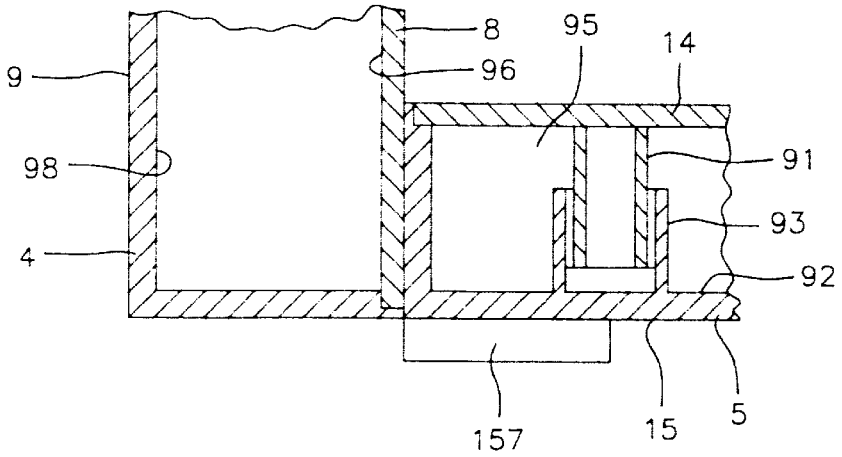
FIG. 13 is an enlarged view of detail "D" of FIG. 8.
Figure 14:
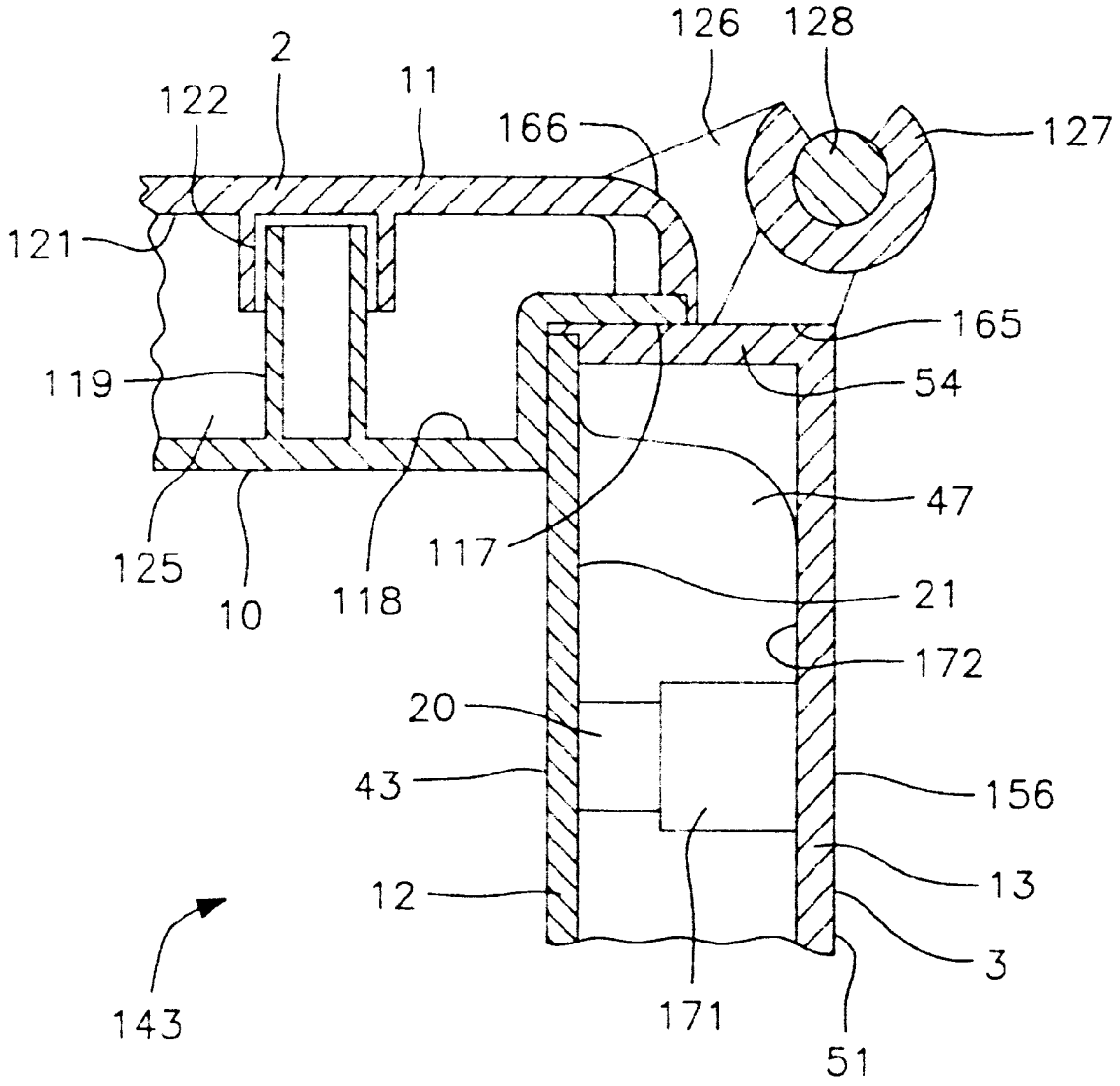
FIG. 14 is an enlarged view of detail "E" of FIG. 8.

FIGS. 10–11, in particular, show recesses 120 in base piece 8 which extend toward skin piece 9. The side walls 150 and end wall 151 of each recess 120 serve as spacer means between pieces 8 and 9. The recesses also serve to accommodate respective guide channels 103 which have a generally U-shaped cross section and which extend over nearly the entire inner width of the front wall 4 between the side walls 6 and 7. Each channel 103 has a guide chamber 104 which extends over the entire length of the channel 103. Projections 106 which extend upward and downward, are provided on the opposing arms 105 of the channel 103 in the region thereof near the interior of the box. A guide slot 108 is formed between the end faces 107 of these projections 106. Joint elements 109 disposed at the side walls 6, 7 are guided in the guide channels 103.

Figure 16:
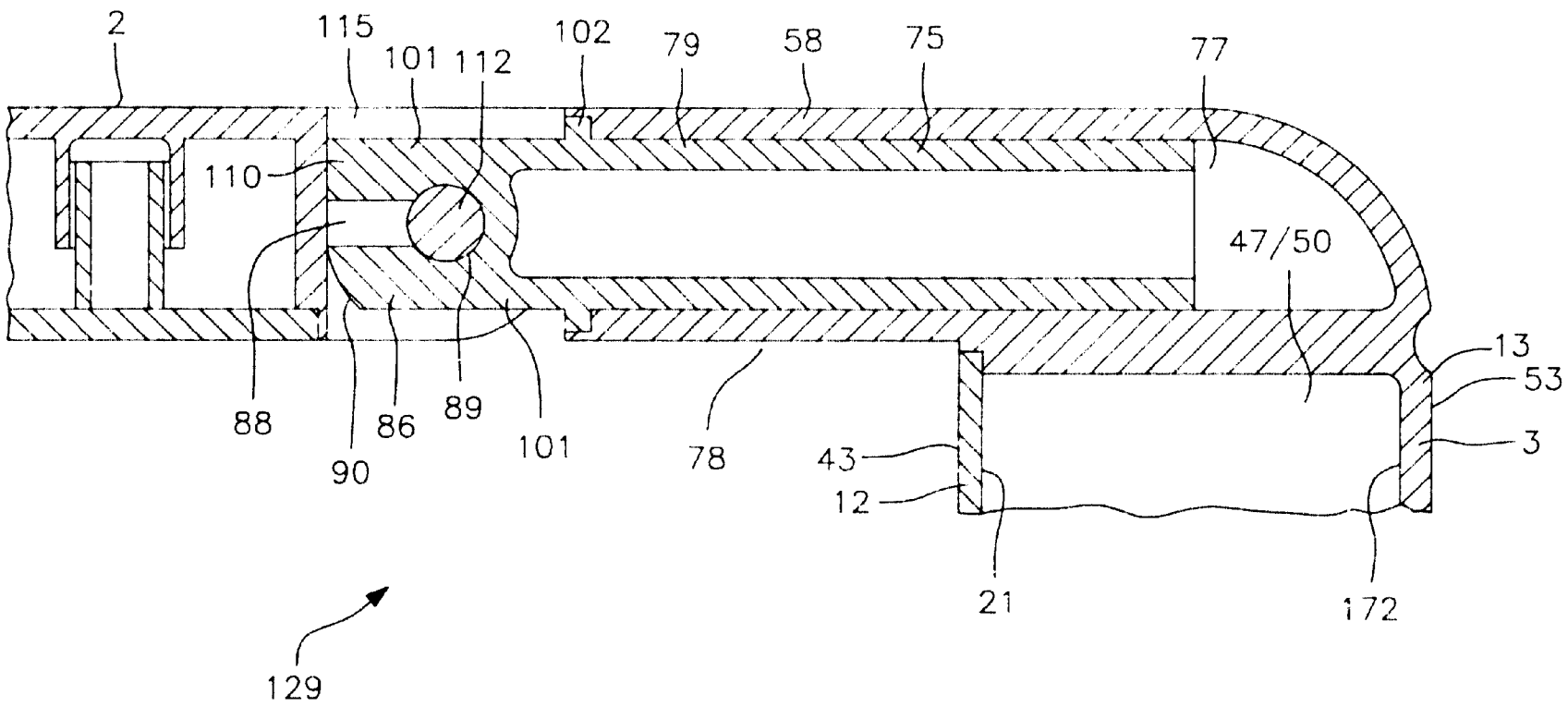
FIG. 16 is an enlarged view of detail "G" of FIG. 9.

Recesses 152 are provided in the side walls 6, 7 at the altitude of the channels 103. Vertically projecting hinge journals 111 are provided in these recesses. The heads 153 of the joint elements 109 are hammer-shaped; they are inserted into and engage the guide chambers 104 of the channels 103 and undercuttingly engage the projections 106 on the arms 105. A fork-type hinge bearing 113 is formed on each hinge member head 153 and extends out of the guide slot 108. The fork-type bearing 113 can be clipped around the journal 111 by slight spreading of the arms 114 of the bearing 113. As shown in FIGS. 8, 9, and 16, the opposite ends of the side walls 6, 7 bear respective hinge plates 115 which are interspersed between fork-type hinge bearings 101 on the rear wall 3, where they are engaged with bearing journals 112.

The cover 2 is in the form of a hollow-chamber profile, similarly to the other principal components of the box. It is comprised of a base piece 10 and a skin piece 11. Base piece 10 is essentially a flat plate having lap-type recesses 116, 117 at its respective edges. It bears supporting pins 119, 154 on its inner side 118 facing the skin piece 11. These pins cooperate with corresponding sleeves 122 disposed on the inner side 121 of the skin piece 11. Spacing cross-members 123 (which may be web members) and external cross-members 124 provide at least one hollow chamber 125 between the base piece 10 and skin piece 11. Hinge plates 126 are borne on the edge of the cover 2 directed away from the front wall, which plates 126 extend interspersedly between fork-type hinge bearings 127 associated with rear wall 3; and said plates 126 may themselves bear bearing journals 128 which extend transversely from said plates and engage the bearings 127 in clip fashion. In variants, the journals 128 may extend through openings in the plates 126 or may be engaged in clip fashion in notches in said plates 126.

The other hinge elements of the side wall, rear wall, etc. are similarly configured to those described above. In particular, the various hinge elements are configured so as to provide disassemblable hinge joints 129 between the rear wall 3 and the respective side walls 6, 7; and 130 between the rear wall 3 and the bottom member 5. It is further a feature of the invention that the individual components of the box (rear wall 3, front wall 4, bottom member 5, side walls 6, 7, and cover 2) are themselves fabricated from separate modules which can be assembled together without screws or rivets, and said components in turn can be assembled together to form the box without such fasteners.

Engaging-and-locking members 132 are provided on the respective lateral edges 131 of the cover 2 (FIGS. 1–9) near the side walls 6, 7. Each such member 132 may be integrally formed on the corresponding edge 131 or may comprise a separate piece which is mounted on the cover 2 by clip means. A generally U-shaped carrying handle 25 is pivotably engaged by the engaging-and-locking members 132. The downwardly directed legs 133 of handle 25 have respective elongated longitudinal slots 134, through which the members 132 extend. The free ends of the handle 25 are in the form of double hooks 135, 139. The distance between the legs 133 of the handle 25 is such that the engaging surfaces 137 of the hooks 135 can engage around respective retention nubs 136 exterior to the side walls 6, 7. In order to engage said nubs (or to disengage from them), the handle can be swung approximately around the axis of the engaging-and-locking members 132. The longitudinal slots 134 are configured such that the shafts (not shown) of the engaging-and-locking members 132 can engage said slots 134, constraining the handle 25 in swinging and linear sliding movement. A second hook 139 is provided on the handle 25, on the side 138 facing the front wall 4, wherein when the cover 2 is fully opened the hook 139 can engage retention pins 140 extending from the side members (58, 59) of the rear wall 3.

In the state of the portable box illustrated in FIG. 1, all of the components of the box have been unfolded to form the basic box shape. The hooks 135 of the handle 25 engage the retention nubs 136, so that the handle 25 extends vertically above the cover 2.

When the user is finished using the box 1, the box may be folded up, with the bottom member, side walls, cover, and front (or back) wall being folded over into approximately the plane of the back (or front) wall. It is unnecessary to break the connections between the components in order to fold the box in this manner. The procedure is as follows: First, the handle 25 is moved out of engagement with the retention nubs 136. In the initial position shown, the engaging-and-locking members 132 are at approximately the middle positions of the length of the slots 134. Pressing on the cross-member 141 of the handle 25 in the direction of arrow A causes the hooks 135 to disengage from the nubs 136, and can be swung generally around the axis of the members 132 toward the rear wall 3. In the starting position shown in FIG. 1, not only is the handle 25 locked but the cover 2 is also locked over and against the side walls 6, 7, the front wall 4, and the rear wall 3, so that the cover 2 cannot be opened. In this situation, with the hooks 135 of the handle engaging the retention nubs 136 of the side walls 6, 7, the cover is held in place by the kinematic fact that the member 132 cannot be moved out of the slot 134 in the handle 25. If the handle 25 is disengaged from the retention condition, the handle can now be tilted slightly toward the rear wall and then can easily be moved linearly upward until the member 132 comes to abut the lower boundary 142 of the slot 134. At this point the cover 2 can be moved through the positions II–VI (FIG. 2), pivoting around the hinge 143 between the cover 2 and rear wall 3 which hinge is formed from the hinge elements 126, 127, 128.

Figure 3:
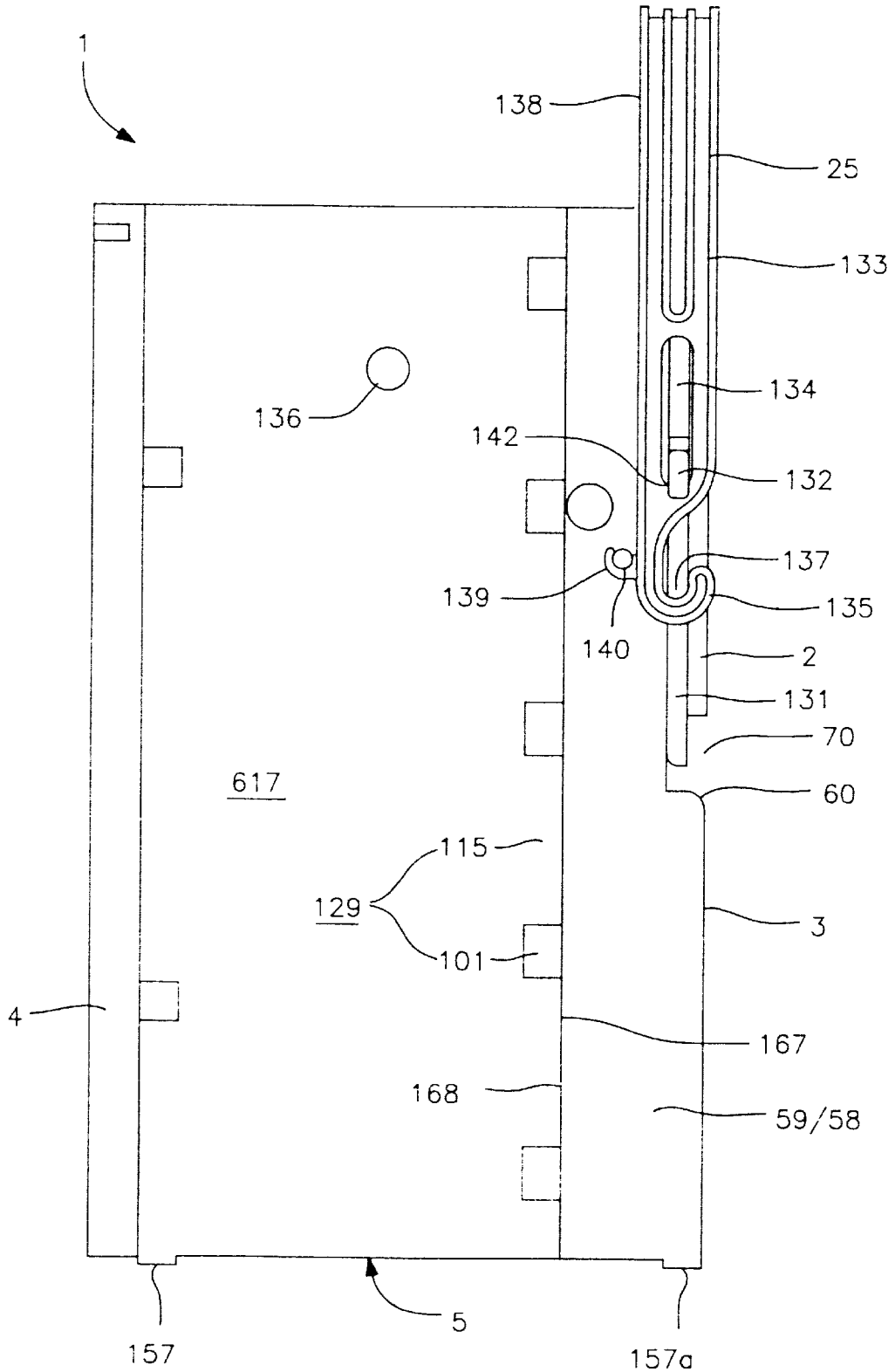
FIG. 3 illustrates the final position after the movement shown in FIG. 2.
Figure 4:
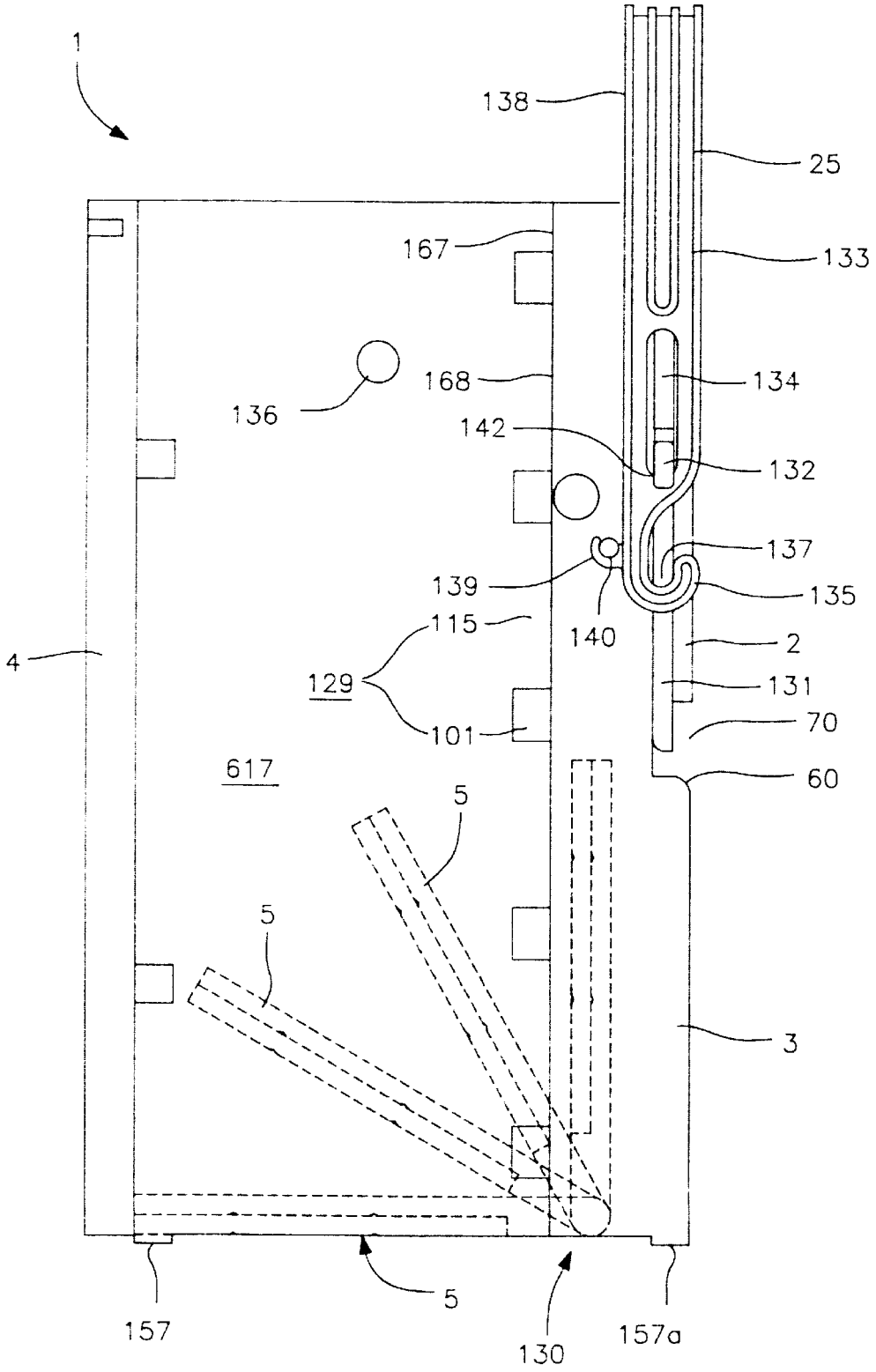
FIG. 4 is a lateral view of the inventive box, wherein the swinging of the bottom at various positions is illustrated.

The handle 25 can be swung around the axis of the member 132, and therefore can be kept vertical throughout the entire swing of the cover 2 to position VII where the cover is accommodated in the recess 70. At this point, the hooks 139 of handle 25 are brought into engagement with the retention pins 140 at the rear wall 3 (FIG. 3).

To further collapse the box 1 and make it more compact, the bottom 5 is now swung inward to the maximum extent against the inner surface 43 of the rear wall 3. This swinging is around the hinge 130 comprised of the elements 26, 27, and 40 (FIG. 4) (see also FIG. 15). A gripping recess (not shown) is provided in the inner side of the bottom member 5 to assist in lifting it.

Figure 5:
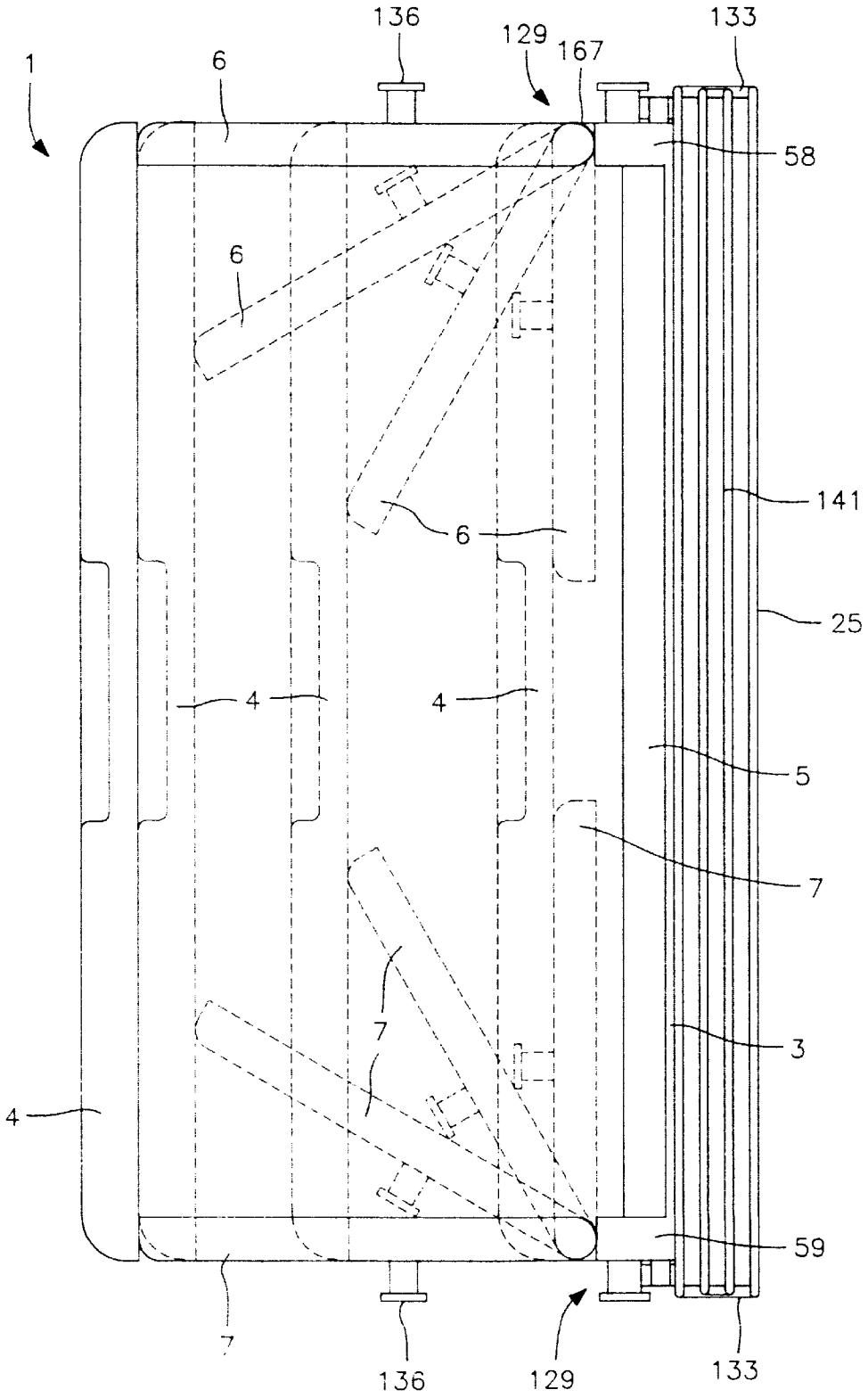
FIG. 5 is a plan view of the box, wherein the swinging of the side walls and the movement of the front wall are illustrated.
Figure 6:
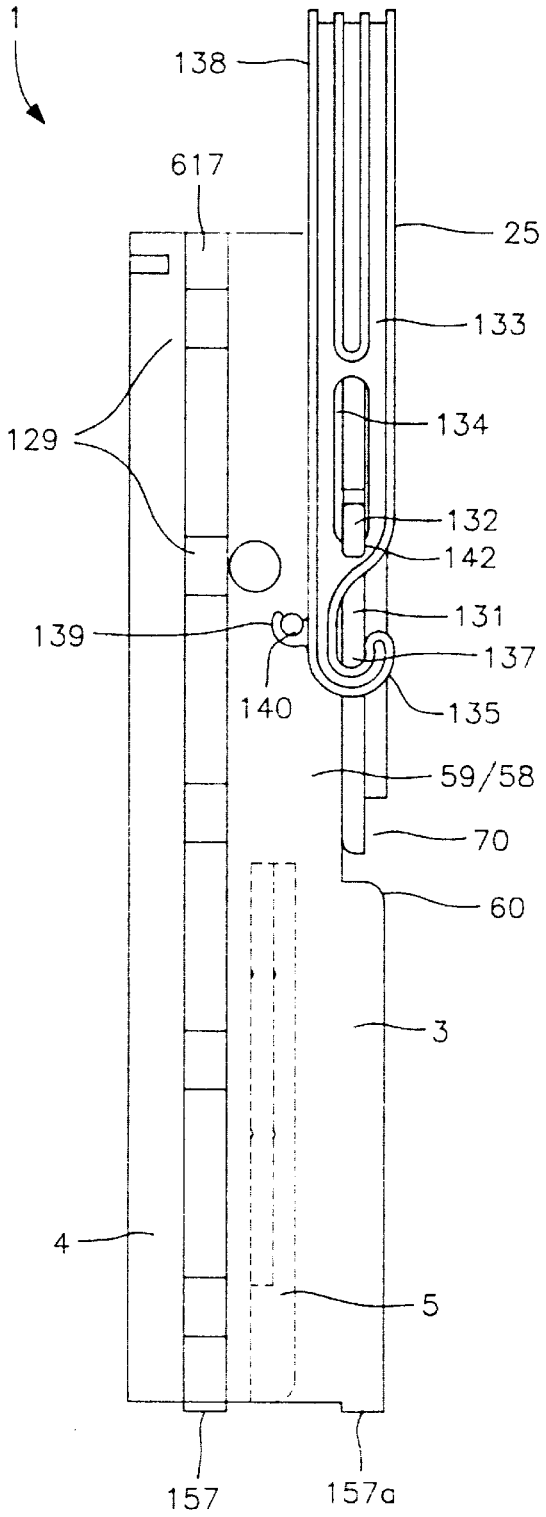
FIG. 6 is a lateral view of the folded-up box.
Figure 7:
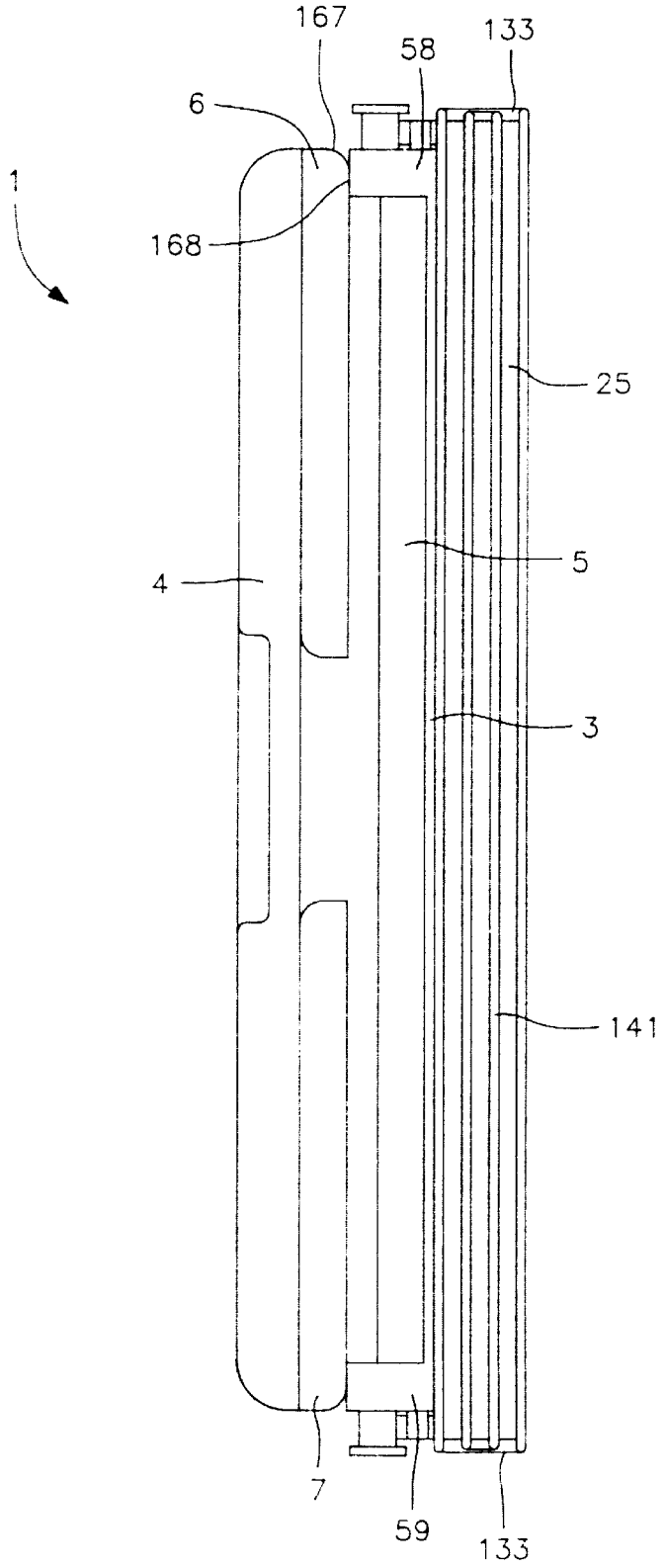
FIG. 7 is a plan view of the folded-up box.

FIG. 5 illustrates the swinging of the side walls 6 and 7 while being continuously articulatedly interlinked with the front wall 4. The final position of the walls 6, 7, and 4 is shown in FIGS. 6 and 7. For further illustration relevant to the process, see FIGS. 8 and 5. As the side walls 6 and 7 are swung around their hinges 129, the hammer-shaped head members 153 of the joint elements 109, which head members are confined in the guide channels 103, are guided along the guide chambers 104 and are prevented by the projections 106 from being pulled out of the channels 103. Consequently, the front wall 4 is moved synchronously with the swinging movement of the side walls 6, 7. The joint elements 109 are not subjected to compressive jamming forces because they can rotate around the journals 111. Thus the front wall is brought into its final position (FIGS. 6, 7) simultaneously with the swung-in side walls 6, 7.

The strips 157 and 157*a* (FIGS. 13 and 15) have an important function for the box in the unfolded state as well as the folded state. Strip 157 provides a support and a detent to limit the outward swing of bottom member 5. Because strip 157 extends outwardly of the bottom side of the bottom member 5, a corresponding strip 157*a* of the same thickness is provided on the bottom side of the side wall 3. Thereby the box stands straight.

Figure 17:
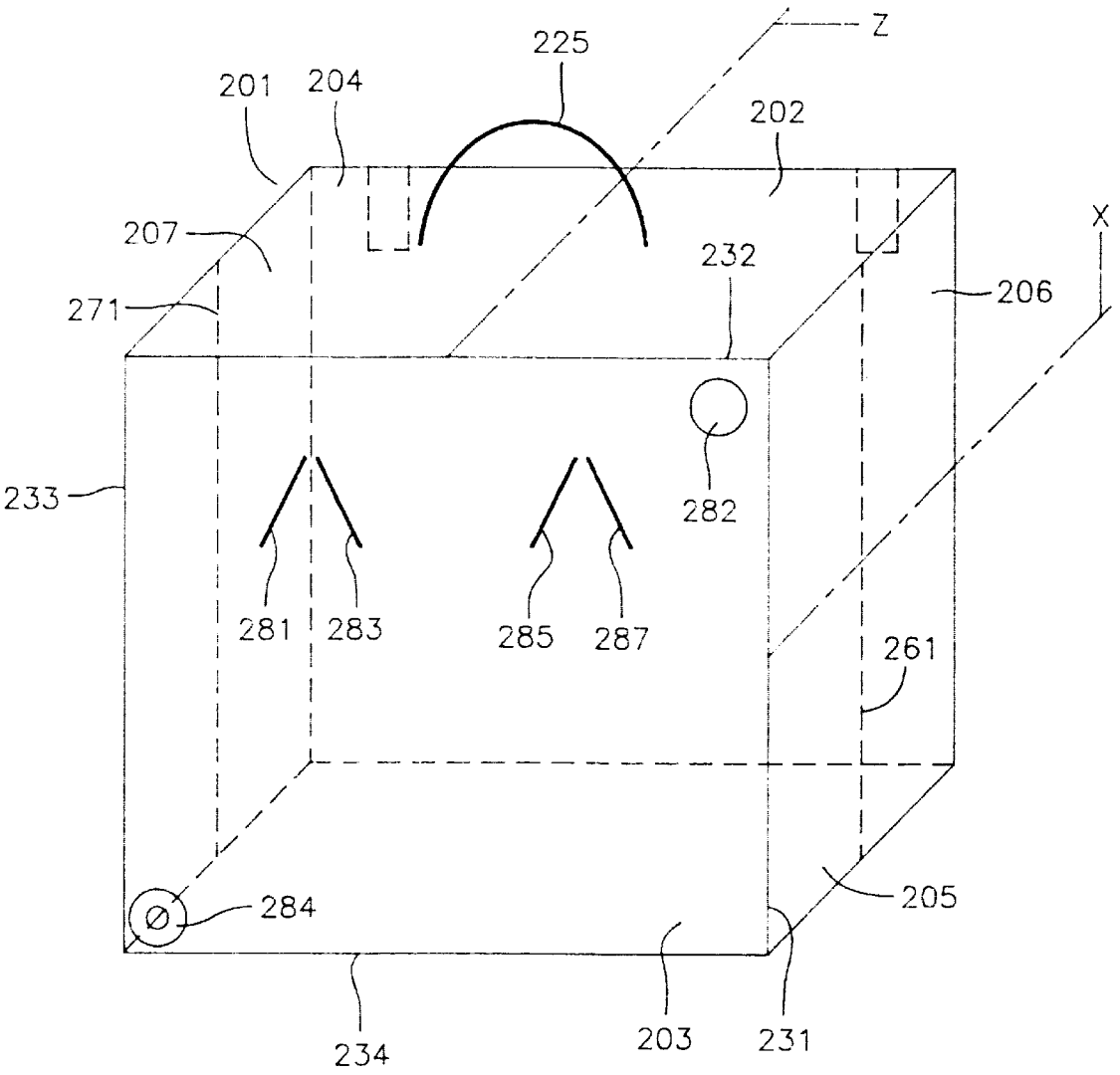
FIG. 17 is a schematic perspective drawing of a simplified embodiment.

FIG. 17 is a schematic perspective rear view of a variant 201 of the box which is essentially rectangular in shape and has stiff outer walls (front wall 204, rear wall 203, cover 202, side walls 206 and 207, and bottom member 205). The outer walls 206, 202, 207, and 205 are pivotably connected to the rear wall 203 along their side edges 231, 232, 233, and 234. The side walls (206, 207) have respective central folding lines 261, 271 parallel to the plane of the rear wall 203; these lines are shown as dotted lines in FIG. 17.

The side walls 206, 207 can be folded inward along the lines 261, 271, whereby the front wall 204 can be moved backward against the rear wall 203 via the intermediary of the side walls (206, 207), as said side walls are folded inward. To accomplish this, first one unfastens catch means which are present which fasten the cover 202 and the bottom member 205 to the front wall 204. The cover 202 can then be swung down, and the bottom 205 can swung up, around their edges 232, 234, respectively, wherein these components 202, 205 will lie over the front wall 204. The cover 202 and bottom 205 may be secured in this position by catch means.

The rear wall bears two pairs of strips comprised of the strips 281, 283 and 285, 287 (FIG. 17), which strips project outward. The strips 281, 283 of the first pair subtend an acute angle directed upward. The strips 285, 287 of the second pair, disposed at the same altitude as those of the first pair, also subtend an acute angle directed upward. The described strips are intended to engage holding means (not shown) for mounting the box on, e.g., a shopping cart (not shown).

Figure 18:
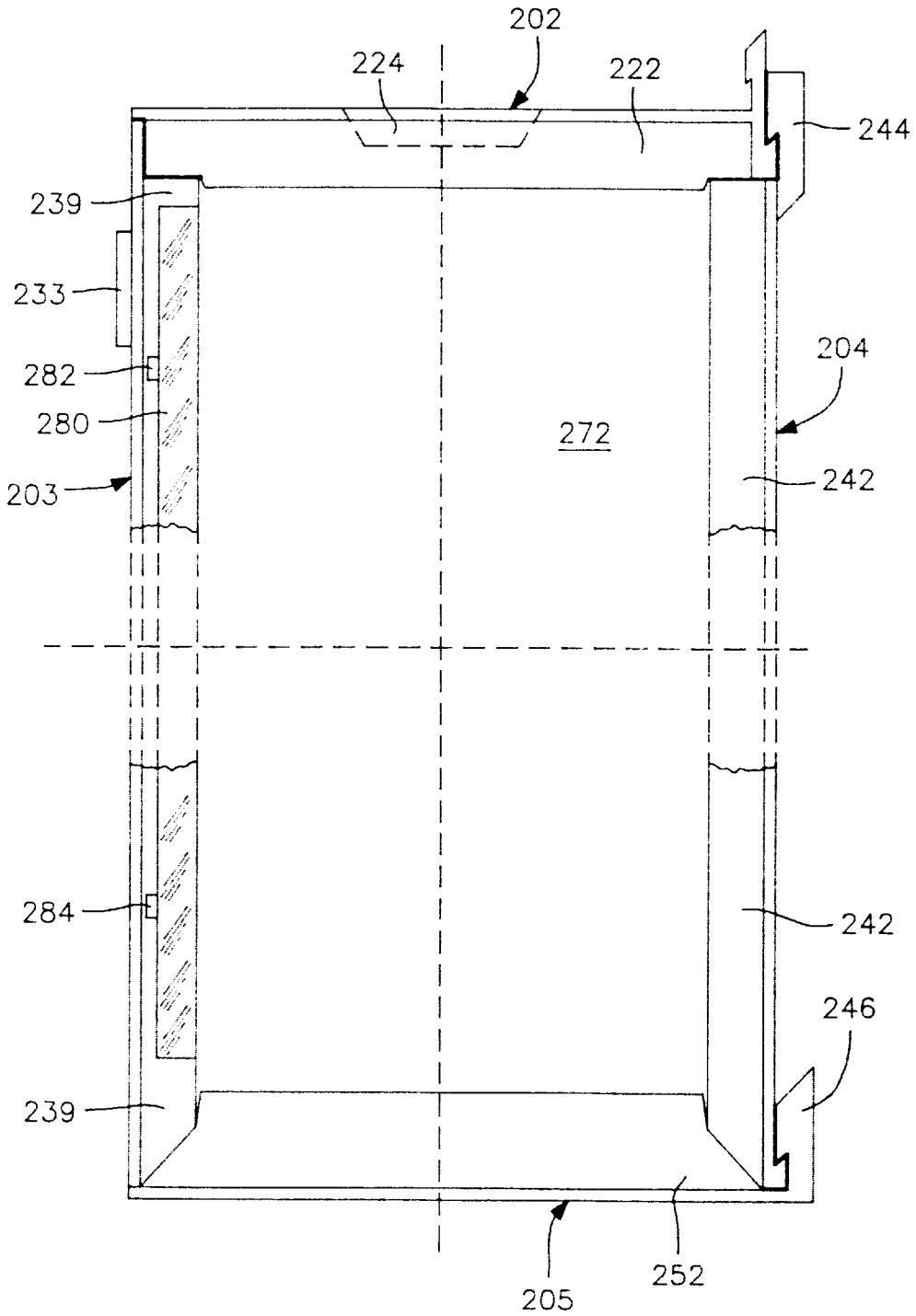
FIG. 18 is a vertical cross section of the box of FIG. 17 through line Z.

The cross section shown in FIG. 18, which is a cross section through line Z of FIG. 17, shows the interior of the box lined with a thick lining of thermal insulation material (222 on the cover 202, 242 on the front wall 204, 252 on the bottom 205, and 239 on the rear wall 203. The insulation 239 has a hollow cavity 280 in it; the interior space of this cavity communicates with the exterior of box 201 via a filling valve 282 and a discharge valve 284. Cavity 280 serves to hold a coolant, which may be in the form of a gas cooled to a low temperature, which the user of the box 201 can introduce to the cavity 280 from a central reservoir, via the filling valve 282.

FIG. 18 also shows the manner in which the cover 202 and bottom member 205 can be affixed by means of V-notched catch strips (244, 246) on the upper and lower parts of the front wall 204.

FIG. 18 further shows a depression 224 provided in cover 202 to accommodate a handle 225 fixed to the cover.

Figure 19:
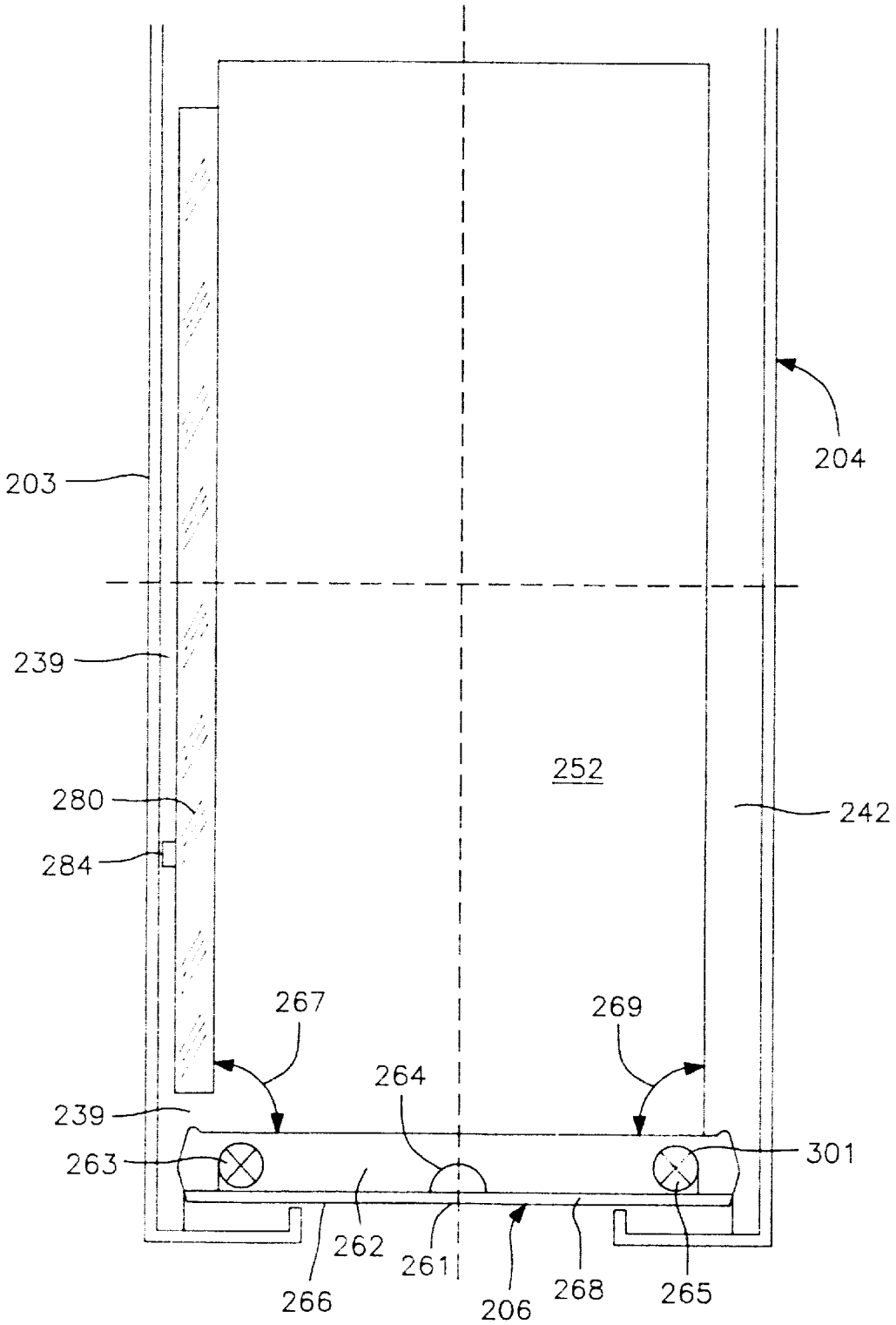
FIG. 19 is a horizontal cross section of the box of FIG. 17 through line X.

A partial view of a horizontal cross section through line X of FIG. 17 is shown in FIG. 19, which illustrates an exemplary embodiment of a side wall 206. The inside of the bottom 205 of the box 1 is covered with insulating material 252, and the inside of the side wall 206 is covered with insulating material 262. A hinge 264 is provided in the middle of side wall 206 along the folding line 261. This hinge extends generally over the entire height of side wall 206. The insulation material 262 is divided along line 261. The resulting half side-walls 266, 268 joined by the hinge 264 are connected to the rear wall 203 and front wall 204, respectively, by respective pin-type hinges 263, 265. This enables the half side-walls 266, 268 to be swung inward according to double arrows 267 and 269 without breaking the connection between the front wall 204 and rear wall 203. As the half side-walls 266, 268 are thus swung inward above the insulation material 252 of the bottom member 205, and the corresponding movement is executed by the half side-walls of the side wall 207, the front wall 204 is moved toward rear wall 203 while being kept generally parallel to said rear wall.

Figure 20:
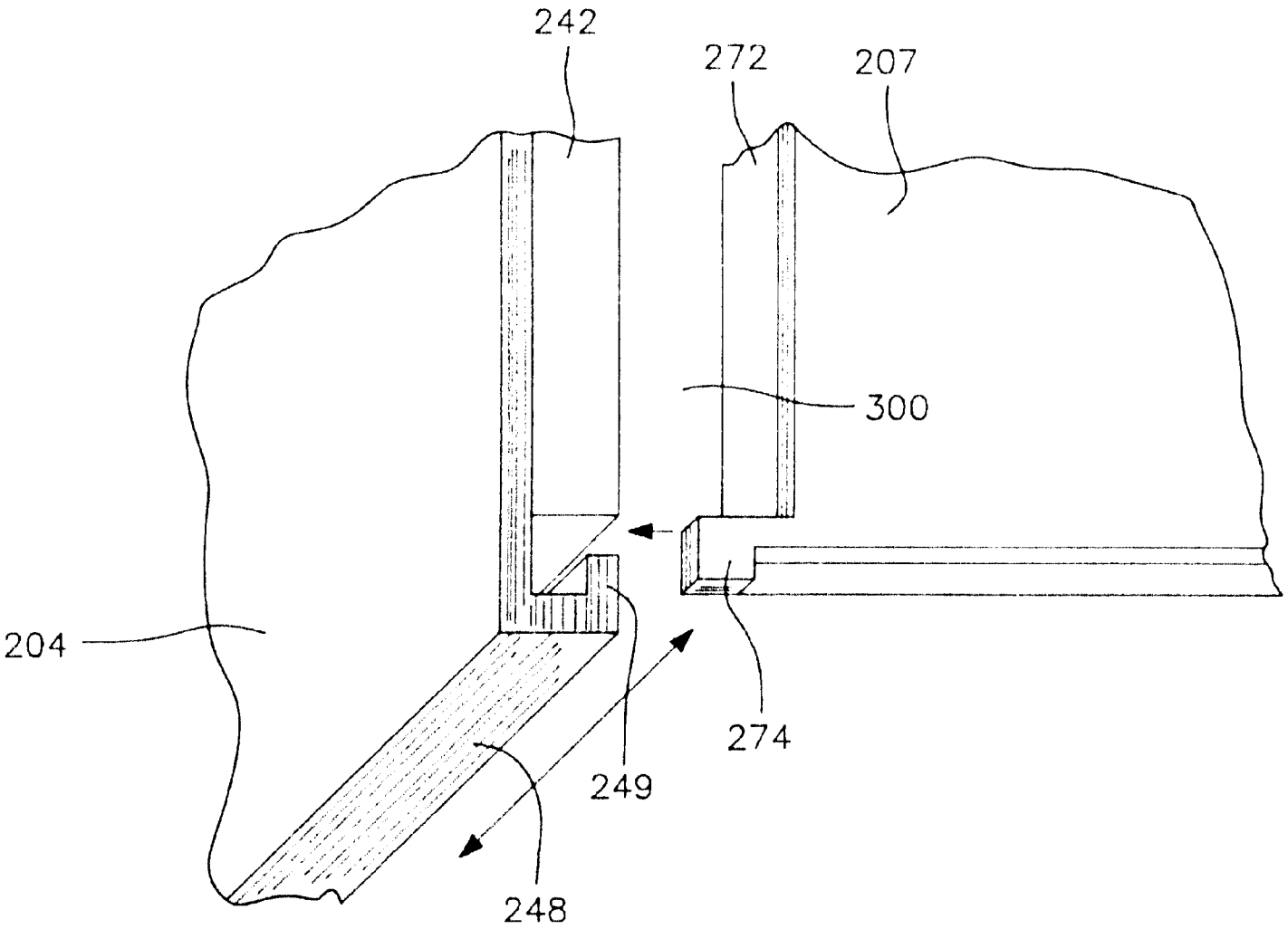
FIG. 20 is a schematic drawing of a different embodiment, showing different means of joining two outer walls of the box according to FIG. 17.

In an alternative embodiment of box 201, the side walls 206, 207 are not divided; thus the folding lines 261, 271 are not present. The side walls 206, 207 may be connected to the rear wall by hinges similar to hinge 263. A preferred embodiment of the means joining the side walls 206, 207 to the front wall 204 is illustrated schematically in FIG. 20. The lower end of side wall 207 is provided with an angle member 274 which projects from it in the direction of the front wall 204. A corresponding L-profiled strip 248 is provided along the lower edge of the front wall 204, which profile 248 is dimensioned such that its upwardly extending border 249 which is parallel to the surface of the front wall 204 can undercuttingly engage the bent part of the angle member 274. As is seen, the insulating material 242 has been appropriately cut away in the region of the angle member 248.

Similar connections to that shown between the lower end of side wall 207 and the front wall 204 are provided at the upper end of side wall 207, and at the upper and lower ends of the opposite side wall 206.

This makes it possible to swing the side walls 206, 207 inward in a path above the insulating material of the bottom member 205. It is recommended that the dimensions of the box 201 be chosen such that the width of a side wall 206, 207 is only half the width of the front wall 204. In order to fold up the box 201, the two side walls 206, 207 can be swung against the rear wall 203, wherein as they are swung they will pull the front wall 204 with them toward the rear wall 203.

Figure 21:
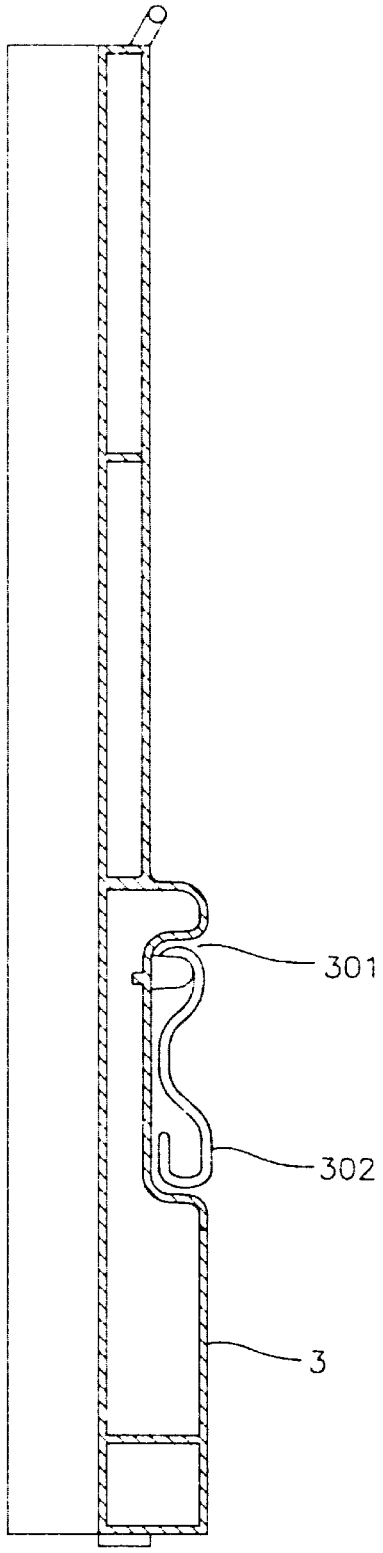
FIG. 21 is a cross section through the rear wall of the box according to FIG. 1.

FIG. 21 shows a cross section of the rear wall 3, where one can see a recess 301 which is suitable for accommodating hooks 302.

Figure 22:
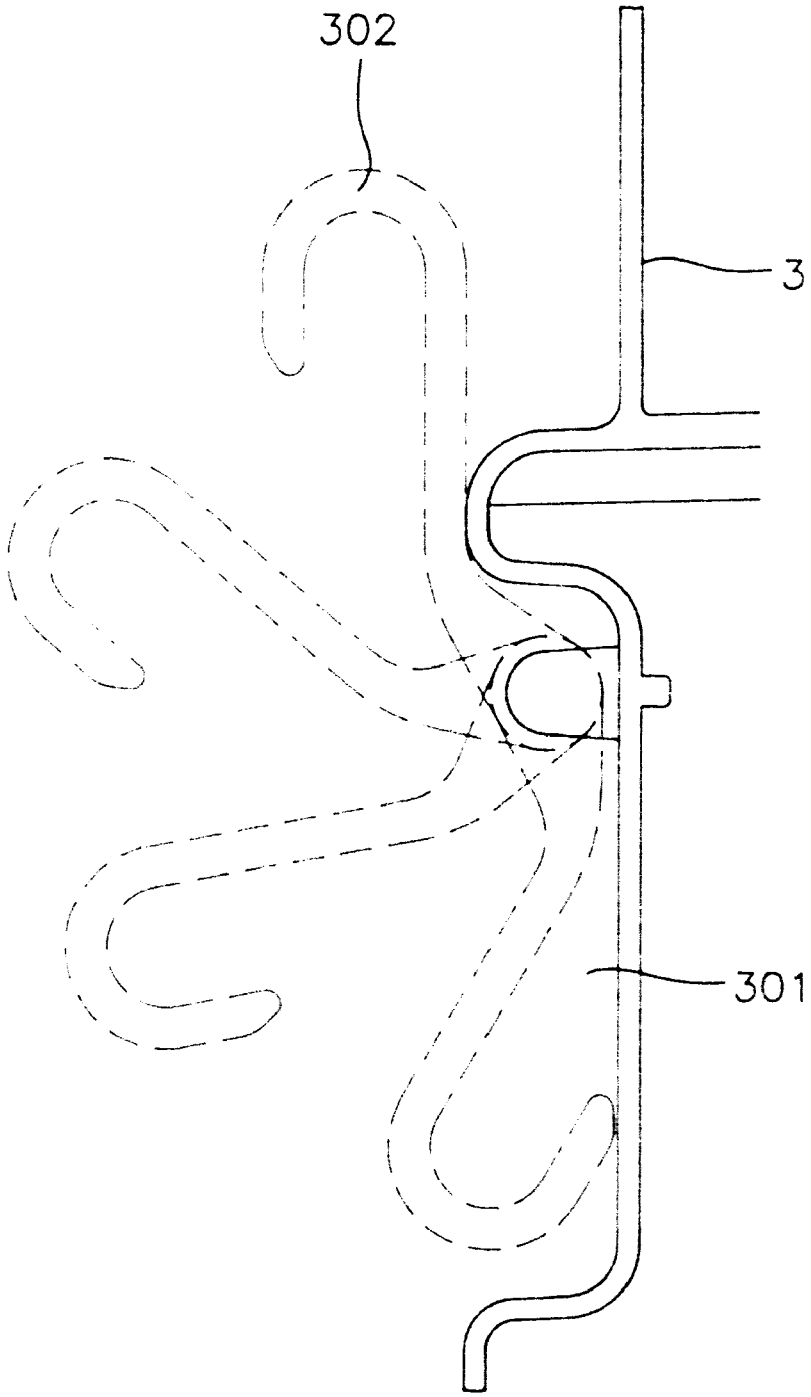
FIG. 22 is an enlarged detail of FIG. 21, rotated through 180°.

FIG. 22 is an enlarged view of a detail of FIG. 21, rotated 180°. The range of swingability of one of the hooks 302 is illustrated. When not in use, the hooks 302 are disposed out of the way in the recess 301.

We claim:

1. A rectangular, portable box having stiff components including side walls, cover, bottom member, front wall, and rear wall, which components are movably interconnected such that said components can be folded or collapsed onto one generally planar surface, which may be that of the bottom member, the rear wall, one of the side walls, or the front wall; comprising at least one rotatable connection between at least two components of the box is comprised of at least one guide channel extending along a first one of the box components and a joint element associated with a second one of the box components which joint element is linearly slidably accommodated in said guide channel, wherein said second one of the box components is rotatable about a non-displaceable swing axis by said rotatable connection to a third one of the box components, wherein the rotatable connection is separate from said joint element, wherein the first one of the box components is moved toward and is parallel to the third one of the box components.

2. The box according to claim 1, wherein the rotatable connection connects each of the side walls and the front wall.

3. The box according to claim 1, wherein the rotatable connection comprises a hinge connection provided between the bottom member and the rear wall, which hinge connection is comprised of fork-like hinge bearings and hinge plates disposed on neighboring edges, which bearings and plates are disposed in an interspersed arrangement, wherein a hinge journal passes through said bearings and plates such that the bottom member can be swung against an inner surface of the rear wall.

4. The box according to claim 1, the rotatable connection comprising a hinge connection provided between the cover and rear wall, which hinge connection is comprised of fork-like hinge bearings and bearing plates disposed in an interspersed arrangement, wherein a hinge journal passes through said bearings and plates such that the cover can be swung against an outer surface of the rear wall.

5. The box according to claim 1, the rotatable connection comprising a hinge connection provided between respective side walls and rear wall, which hinge connection is comprised of fork-like hinge bearings and bearing plates disposed in a mutually interspersed arrangement, wherein a hinge journal passes through said bearings and plates such that the side walls can be swung against an outer part of the bottom member after said bottom member has been disposed against an inner surface of the rear wall, and wherein, during the swinging movement of the side walls the front wall can be moved toward the rear wall such that the front wall comes to rest against said side walls after the side walls have been disposed against the bottom member which has been swung in.

6. The box according to claim 1, wherein the second one of the box components comprises the side wall, such that the joint element is associated with the side wall, which joint element is linearly movably accommodated in the guide channel of the front wall and swingable around a respective bearing journal which is disposed near the front wall (4) at an end structure of the respective side wall and which extends vertically between the cover and bottom member.

7. The box according to claim 6, wherein the bearing journals are each disposed in a recess in the respective side wall, which recess is open on an end face directed toward the front wall and on an exterior side of the side wall.

8. The box according to claim 7, further comprising a given fork-shaped element associated with a side wall and having a hammer-shaped head member and a fork-shaped bearing member formed on said head member, wherein the fork-shaped bearing member encirclingly engages the bearing journal in kinematic engagement, and wherein said head member projects beyond the end face of the side wall.

9. The box according to claim 1, wherein the guide channel is disposed in a recess in or on the front wall which recess is open toward an interior space of the box and extends transversely between the side walls.

10. The box according to claim 9, wherein the guide channel is U-shaped, and forms a guide chamber for the hammer-shaped head of the joint element, wherein said head is undercuttingly engaged by two oppositely directed projections on the guide channel.

11. The box according to claim 1, wherein at least one of the box components is in the form of a hollow chamber profile.

12. The box according to claim 1, wherein at least one box component is comprised of a base piece and a skin piece.

13. The box according to claim 12, further comprising fastening means connected to the base piece and an associated skin piece to form a hollow chamber profile.

14. The box according to claim 13, wherein said fastening means is disposed on respective neighboring inner sides of said base piece and skin piece.

15. The box according to claim 1, wherein the rear wall has a step which forms a recess in an outer side of said rear wall, which recess is suitable for accommodating the cover when said cover is swung open.

16. The box according to claim 1, further comprising a support strip provided on the front wall, the bottom member abutted against the support strip.

17. The box according to claim 1, wherein the rear wall has side members which extend in planes of the side walls and form part of said side walls.

18. The box according to claim 17, wherein the side members are in the form of hollow chamber profiles suitable for accommodating hinge arms.

19. The box according to claim 1, further comprising a pocket-like compartment provided on an inner surface of the rear wall, the pocket-like compartment accommodating cooling elements.

20. The box according to claim 1, further comprising retention nubs provided on exterior sides of the side walls, which nubs can be undercuttingly engaged by hook-shaped arms having hook members borne on a carrying handle.

21. The box according to claim 20, wherein the carrying handle is in the form of a generally U-shaped member with arms extending parallel and at a mutual distance to the exterior sides of the respective side walls, wherein said arms each bear one or more hooks at free ends of the arms.

22. The box according to claim 21, wherein each of the said arms is penetrated by an elongated slot which extends in the longitudinal direction of the arm, which slot slidably accommodates an engaging-and-locking member disposed on the respective side of a cover, which member serves as a rotational or swinging pivot.

23. The box according to claim 22, wherein the engaging-and-locking members are rotationally rigidly fixed to the cover.

24. The box according to claim 23, further comprising a retention pin disposed on each respective side member of the rear wall, which pin can be undercuttingly engaged by a hook borne by the respective arm of the carrying handle.

25. The box according to claim 1, wherein the components of the box are lined, interiorly or exteriorly with thermal insulation material.

26. The box according to claim 1, further comprising a cavity which can be filled with a coolant medium, the cavity provided in the rear wall and/or the front wall and/or a cover.

27. The box according to claim 26, wherein said cavity has a filling valve and a discharge valve.

28. The box according to claim 1, wherein each side wall is articulated at a central folding line which extends parallel to the rear wall.

29. The box according to claim 1, wherein the rear wall is profiled to facilitate hanging the box on a shopping cart.

30. The box according to claim 29, wherein said profile elements comprise strips formed on the rear wall, which strips project from the rear wall.

31. The box according to claim 29, wherein said profile elements are disposed in an angular arrangement.

32. The box according to claim 1, further comprising guide strips disposed on an inner side of the front, back, and/or side walls, which guide strips are engaged by guide elements borne on one or more other side walls.

33. The box according to claim 1, further comprising catch means releasably fixing outer wall elements of the components when said components are folded or collapsed as well as when said components are in an assembled or outwardly-swung state.

34. The box according to claim 1, further comprising at least one recess provided in the rear wall, which recess is open toward an exterior of the box and can accommodate at least one swingable hook.

35. The box according to claim 1, further comprising means for lifting the bottom member provided in or on an inner side of the bottom member.

* * * * *